US009797164B2

(12) United States Patent
Knoll

(10) Patent No.: US 9,797,164 B2
(45) Date of Patent: Oct. 24, 2017

(54) COMBINATION LOCK

(71) Applicant: KNOLLAN LTD., Ramat Ishai (IL)

(72) Inventor: Yehonatan Knoll, Ramat Ishai (IL)

(73) Assignee: KNOLLAN LTD., Ramat Ishai (IL)

( * ) Notice: Subject to any disclaimer, the term of this patent is extended or adjusted under 35 U.S.C. 154(b) by 375 days.

(21) Appl. No.: 14/367,365

(22) PCT Filed: Dec. 20, 2012

(86) PCT No.: PCT/IL2012/050540
§ 371 (c)(1),
(2) Date: Jun. 20, 2014

(87) PCT Pub. No.: WO2013/093918
PCT Pub. Date: Jun. 27, 2013

(65) Prior Publication Data

US 2014/0338406 A1 Nov. 20, 2014

Related U.S. Application Data

(60) Provisional application No. 61/577,753, filed on Dec. 20, 2011.

(51) Int. Cl.

| | |
|---|---|
| ***E05B 37/14*** | (2006.01) |
| ***E05B 37/00*** | (2006.01) |
| ***E05B 67/00*** | (2006.01) |
| ***E05B 17/00*** | (2006.01) |

(52) U.S. Cl.
CPC ..... *E05B 37/00* (2013.01); *E05B 17/0062* (2013.01); *E05B 37/0058* (2013.01); *E05B 37/14* (2013.01); *E05B 67/003* (2013.01); *Y10T 70/402* (2015.04); *Y10T 70/435* (2015.04)

(58) Field of Classification Search
CPC .. E05B 37/00; E05B 17/0062; E05B 37/0058; E05B 67/003; E05B 37/14; Y10T 70/402; Y10T 70/435
USPC ..... 70/1.5, 1.7, 417, 422, 30, 49, 23–26, 70/38 B, 38 C, 39
See application file for complete search history.

(56) References Cited

U.S. PATENT DOCUMENTS

| | | | |
|---|---|---|---|
| 1,413,525 | A | 4/1922 | Dorozynski |
| 1,866,273 | A | 7/1932 | Sinner |
| 3,823,584 | A | 7/1974 | Gill |
| 3,990,275 | A | 11/1976 | Lippisch |
| 5,868,012 | A | 2/1999 | Chun-Te et al. |

(Continued)

FOREIGN PATENT DOCUMENTS

| | | | |
|---|---|---|---|
| GB | 191222314 | A | 10/1913 |
| JP | 35-6796 | B | 4/1960 |
| TW | 513509 | B | 12/2002 |

OTHER PUBLICATIONS

Chinese Official Action mailed Aug. 31, 2015, 1 page.
Supplementary Partial European Search Report completed Sep. 11, 2015, 3 pages.

*Primary Examiner* — Lloyd Gall
(74) *Attorney, Agent, or Firm* — Vorys, Sater, Seymour & Pease LLP

(57) ABSTRACT

Provided is a combination lock including a housing having an lodge port configured for removably receiving therein a shank; a locking bar received within the housing and having a shank port; a combination mechanism associated with the locking bar; and a securing arrangement including an arresting member of the locking bar.

11 Claims, 26 Drawing Sheets

(56) References Cited

U.S. PATENT DOCUMENTS

| | | | | |
|---|---|---|---|---|
| 6,298,694 | B1 * | 10/2001 | Knoll | E05B 37/00 70/25 |
| 6,363,758 | B1 * | 4/2002 | Ling | E05B 37/025 70/22 |
| 6,609,399 | B1 * | 8/2003 | Daniels, Jr. | B62H 5/003 70/14 |
| 6,718,803 | B2 | 4/2004 | Knoll | |
| 6,862,905 | B2 | 3/2005 | Zapushek | |
| 7,251,965 | B2 | 8/2007 | Yu | |
| 2004/0031298 | A1 | 2/2004 | Lai | |

* cited by examiner

COMBINATION LOCK

FIELD

The present invention is in the field of locks, more particularly, combination locks.

BACKGROUND

Combination locks are a type of lock configured for opening/locking upon input of a predetermined combination, e.g. a sequence of numbers, letters, order of button pressing, a set of displacements etc. One of the advantages of a combination lock is that no external key is required for opening the lock, but rather, only knowledge of the right combination.

In general, combination locks comprise a combination mechanism configured:

- when the lock is in its locked position, for preventing opening of the lock unless the right combination is set, and
- for allowing a user to determine a desired combination when the lock is in its open position, by initiating a reset procedure.

When the proper combination is provided to the combination mechanism, the elements of the combination mechanism are so aligned with a locking mechanism of the combination lock (e.g. a bolt) so as to allow the lock to assume its open position.

PRIOR ART

U.S. Pat. No. 6,718,803 to the applicant discloses a combination lock comprising a housing, a locking bolt and a locking breach, at least one locking assembly rotatably supported within the housing and comprising a disc member formed with a peripheral recess, a cam wheel and a reset cam. A locking member is formed with at least one locking lug angularly displaceable between an un-locked position in which all the locking lugs engage within the peripheral recess of the disc members and where the locking breach is disengaged from the locking bolt, and a locked position in which at least one of the locking lugs is disengaged from the peripheral recess, where the locking breach arrests the locking bolt. A planarly displaceable manipulating member comprises at least one follower corresponding with each cam wheel. A reset mechanism is provided for rotating all disc members into a reset position.

General Description

The subject matter of the present application calls for a unique combination lock configured for securing a combination mechanism thereof from spontaneous displacement and misalignment during an open position of the combination lock.

Thus, according to one aspect of the subject matter of the present application, there is provided a combination lock comprising:

- a housing having a lock port configured for removably receiving therein a shank;
- a locking bar received within the housing and having a shank port, said locking bar being configured for displacing at least between an open position in which the shank port is aligned with the lock port to allow a locking portion of said shank to displace into said housing through both ports, and a securing position in which said shank port is misaligned with the lock port to prevent the locking portion of the shank from displacing outside said housing via the shank port;
- a combination mechanism associated with said locking bar and configured for switching between at least an unlocked position in which said locking bar is free to displace from its securing position to its open position, and a locked position in which said locking bar is arrested;
- a securing arrangement constituted by an arresting member of the locking bar configured for interlocking engagement with an arresting portion of the housing, and a biasing mechanism for urging said locking bar into the interlocking engagement with the arresting portion of the housing, said securing arrangement being configured, when the locking portion of the shank is dislodged from the lock port, for preventing displacement of said locking bar from its open position.

According to another aspect of the subject matter of the present application there is provided a locking bar for a combination lock of the previous aspect of the present application, said locking bar being formed with:

- a shank port for axially receiving therein a locking portion of a shank;
- at least one locking surface configured for operative engagement with the locking portion of the shank during its axial displacement into said shank port, for entailing displacement of said locking bar in a first lateral direction towards a securing position thereof;
- at least one unlocking surface configured for operative engagement with the locking portion of the shank during its opposite axial displacement outside the shank port, for entailing displacement of said locking bar in an opposite lateral direction towards an open position thereof; and
- a tamper proof arrangement by which the at least one unlocking surface is configured for collapsing under the application of a predetermined load thereto, disabling the operative engagement with the locking portion of the shank.

The terms shank and shackle, though not interchangeable, are used hereinafter alternately.

The housing can be formed with a single operative port which is the lock port. The term 'operative' is used herein to refer to a port through which the shank is configured to engage the locking bar of the combination lock. In other words, a port configured for receiving therein a shank not in association with the locking member will not be considered 'operative'.

Nonetheless, the housing can comprise, in addition to the lock port, an additional, non operative port configured for accommodating therein (fixedly or removably) another shank or another end part of the same shank/shackle.

For example, the lock can have a shackle with a first end configured for being received within the operative lock port of the housing and a second end configured for being received within a non-operative port of the housing. One example of such a lock is a padlock. Alternatively, the combination lock can be a cable lock in which a first end of the cable is associated with the shank configured for being received within the lock port of the housing while the second end of the cable is provided with a fixed shank configured for being fixedly received within the housing.

The arrangement can be such that, in the securing position, the bolt member is not in engagement with the shank or any portion thereof, but rather with the housing, combination mechanism or any other arrangement associated with the lock but the shank.

The lock port can be in the form of a shaped opening having a large diameter portion, large enough for receiving therethrough a head of the shank, and a small diameter portion large enough to receive therethrough a neck portion of the shank (of smaller diameter than the head) but not the head itself. The arrangement can be such that, in the open position, the large diameter opening is aligned with the shank port of the housing.

The combination mechanism can be any commonly known combination mechanism such as a number combination, letter combination, a pressing sequence, a displacement sequence etc.

The locking bar can be configured for assuming at least one additional, intermediary position between the securing position and the opened position.

The securing arrangement can be in the form of a male/female association between the arresting member of the locking bar and an arresting portion of the housing. In particular, one of the above can be in the form of a projection and the other in the form of a recess configured for receiving the projection. According to a particular design, the locking port itself can be formed with the arresting portion of the housing.

While, in the securing position, the arresting member of the locking bar is firmly received within the arresting portion, it may still be provided with an operative gap configured for allowing the locking bar with slight play to perform other operations associated with the lock (e.g. resetting).

The biasing arrangement of the securing arrangement can be mechanical, electronic, hydraulic etc. In particular, it may be mechanically configured for urging the locking bar into the securing position. For example, the biasing arrangement can be in the form of a spring or a coil attempting to expand/contract against the locking bar.

The arrangement can be such that the biasing arrangement is configured for urging the locking bar to perform an angular displacement, i.e. apply thereto a combined force attempting to urge the arresting member of the locking bar not only into engagement with the arresting portion of the housing but also to cause firm abutting of one against the other.

The locking bar can be formed with a sliding pivot portion configured for displacing together with the locking bar (can also be integrally formed therewith) and for serving as a pivot point for the locking bar to perform rotation about a pivot axis.

In accordance with a particular example, the locking bar can configured for performing both a lateral displacement and a pivotal displacement about the pivot point in order to switch between its open position and securing position. Specifically, the lateral displacement of the locking bar can be induced by axial displacement of the locking portion of the shank while the pivotal displacement of the locking bar can be induced by the biasing arrangement.

The biasing arrangement can be configured for constraining the locking bar such that, from the securing position of the locking bar, pivotal displacement of the locking bar about its pivot point (induced by applying a load in the axial direction) inevitably entails lateral displacement of the locking bar.

In particular, the arrangement can be such that in order to displace the locking bar from the open position thereof, it is first required to apply a force in one direction for disengagement between the arresting member and the arresting portion and thereafter another force in another direction to displace the locking bar laterally.

The above configuration elegantly allows preventing shifting of the locking bar (and consequently of the combination mechanism from its proper position) during an open position of the lock, as the chances of spontaneous application of the above forces is unlikely. It is also appreciated that in the open position, there is no purpose in deliberately applying these forces other than simple sabotage of the combination lock.

In accordance with one example, both the locking surface and the unlocking surface of the locking bar can be formed at different orientations from one another. Alternatively, the locking bar can be formed with a locking member formed with the locking surface and an unlocking member formed with the unlocking surface.

The locking and unlocking surfaces can be oppositely oriented such that during displacement of the shank in one direction it only engages one of the surfaces whereas during displacement in the opposite direction it only engages the other of the surfaces.

In addition, the shank can be limited to axial displacement within the lock port, wherein engagement between the shank and the locking/unlocking surfaces results in displacement of the locking back in a manner similar to a cam and follower motion.

The tamper proof arrangement of the locking bar can be designed such that the predetermined amount of load applied to the unlocking surface is lower than the load required for displacing the locking bar against other components of the lock, e.g. the combination mechanism. Specifically, the arrangement can be such that when the unlocking surface collapses, the shank is out of engagement therewith, rendering it impossible to apply the desired force in order to displace the locking bar in the right direction.

According to a specific design, the unlocking surface can be formed along a rib projecting transversely from the locking bar and configured, in its collapsed position, to assume an orientation generally parallel to the locking bar.

In the collapsed position above, the locking portion of the shank can be configured to rest directly against the body of the locking bar itself, thereby rendering it impossible to pull out the locking portion of the shank from the housing.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
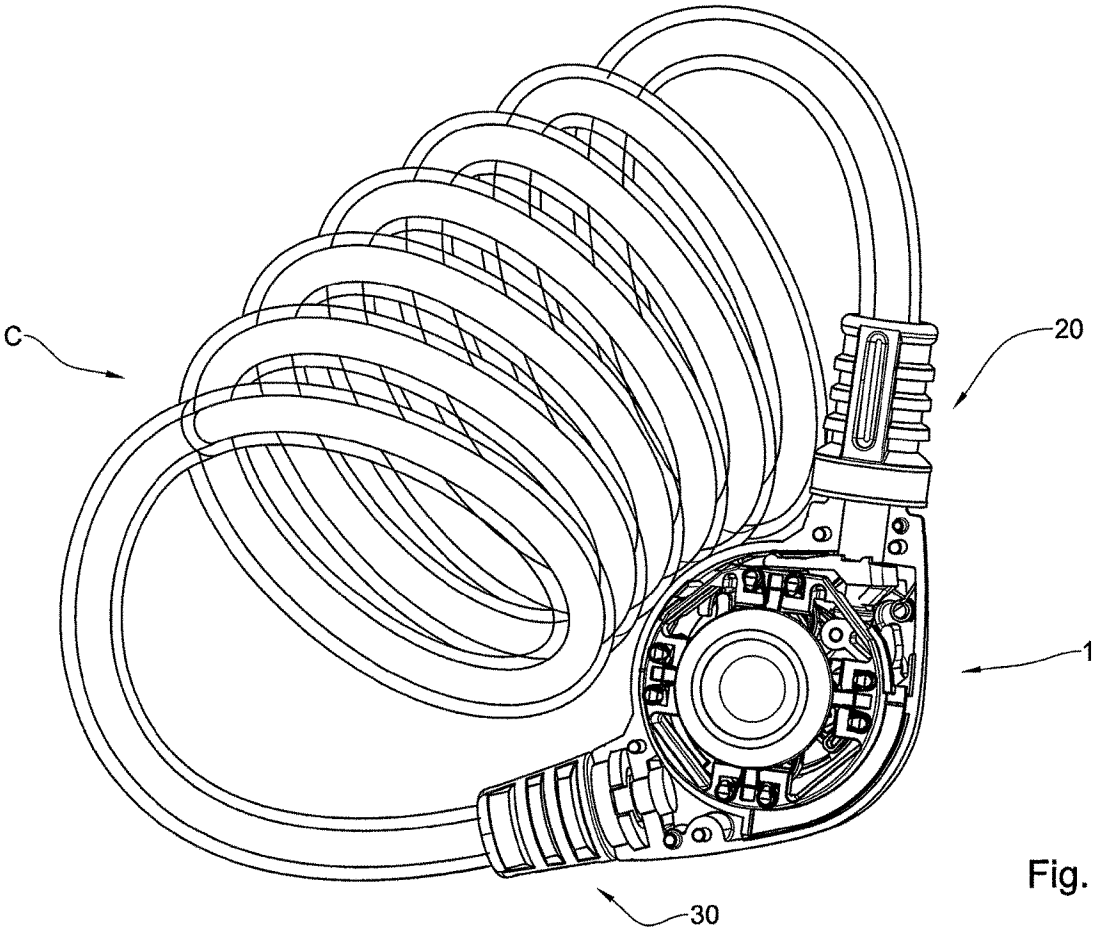
FIG. 1 is a schematic isometric view of a lock according to one aspect of the subject matter of the present application.

Attention is first drawn to FIG. 1 in which a basic design of a combination lock in accordance with the present application is shown, generally being designated as 1. As shown in FIG. 1, the lock 1 is a cable lock and comprises a cable C having a first end 20 configured for being removably received within the lock 1 and a second end 30, fixedly accommodated within the lock 1.

It should be noted here that although the design shown refers to a cable lock, it is applicable to any combination lock having a single operative port, i.e. a single port configured for receiving therein a shank (also referred herein as shackle) associated with other mechanisms accommodated within the lock e.g. bolt, combination arrangement etc.

Figure 2:
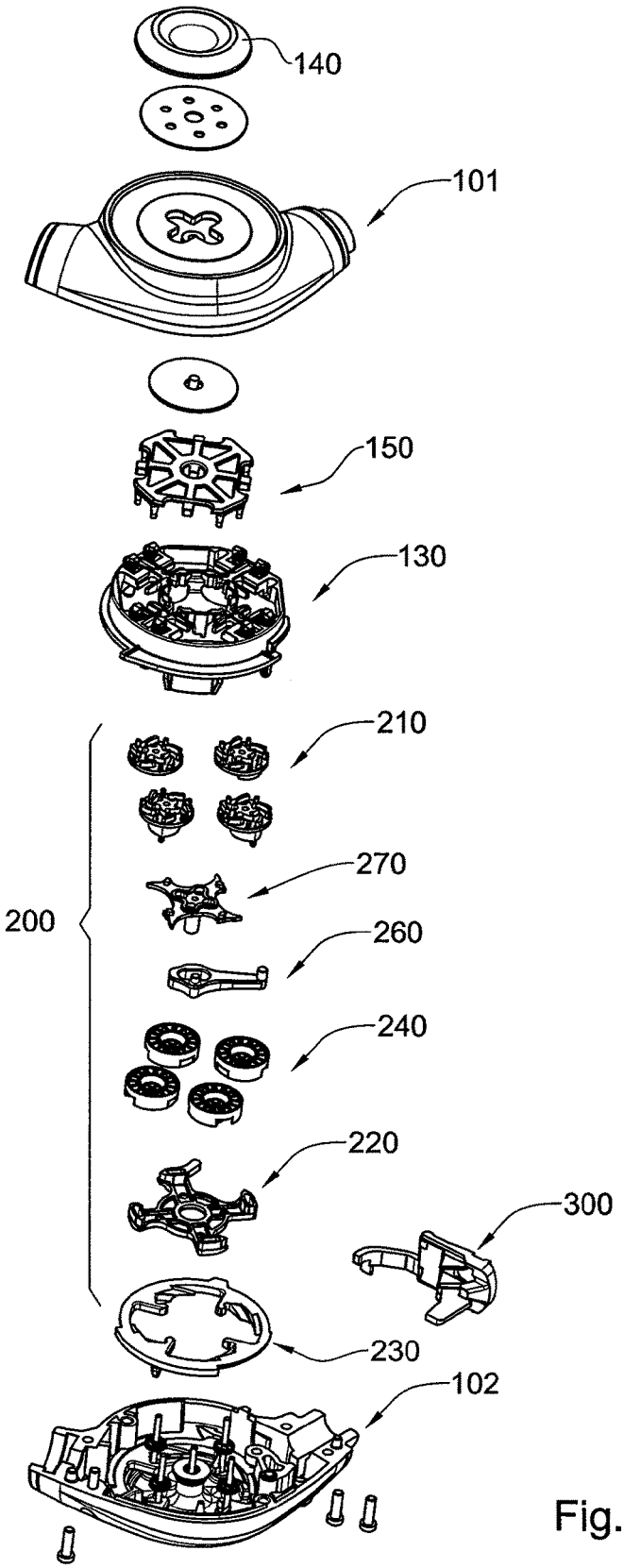
FIG. 2 is a schematic isometric exploded view of the lock shown in FIG. 1.

Turning now to FIG. 2, an exploded isometric view of the lock 1 is shown generally comprising a top and bottom housing covers 101, 102, a combination mechanism 200 including cogs 210, a locking cross 220, a decoding ring 230, discs 240, and reset elements 260, 270. The lock 1 further comprises an actuation arrangement including an actuator housing 130, an actuation plate 150 and an actuator button 140.

The actuation mechanism is associated with the combination mechanism and is effective for setting the proper combination allowing opening/closing of the combination lock.

The design of the combination mechanism 200 and the actuation arrangement is generally known per se from U.S. Pat. No. 6,718,803 which is incorporated herein by reference and will therefore not be described herein in detail.

The lock also comprises a bolt member 300 configured for both lateral and pivotal displacement within the housing 101, 102 at least between an open position allowing insertion of the shank 10 into the housing and a securing position preventing removal of the shank 10 from the housing 101, 102, once inserted therein. As used herein, the term "bolt member" may be used interchangeably with "locking bar". The bolt member 300 is associated with a biasing arrangement 360 so that it is in fact spring loaded to be urged into a predetermined direction.

Figure 5A:
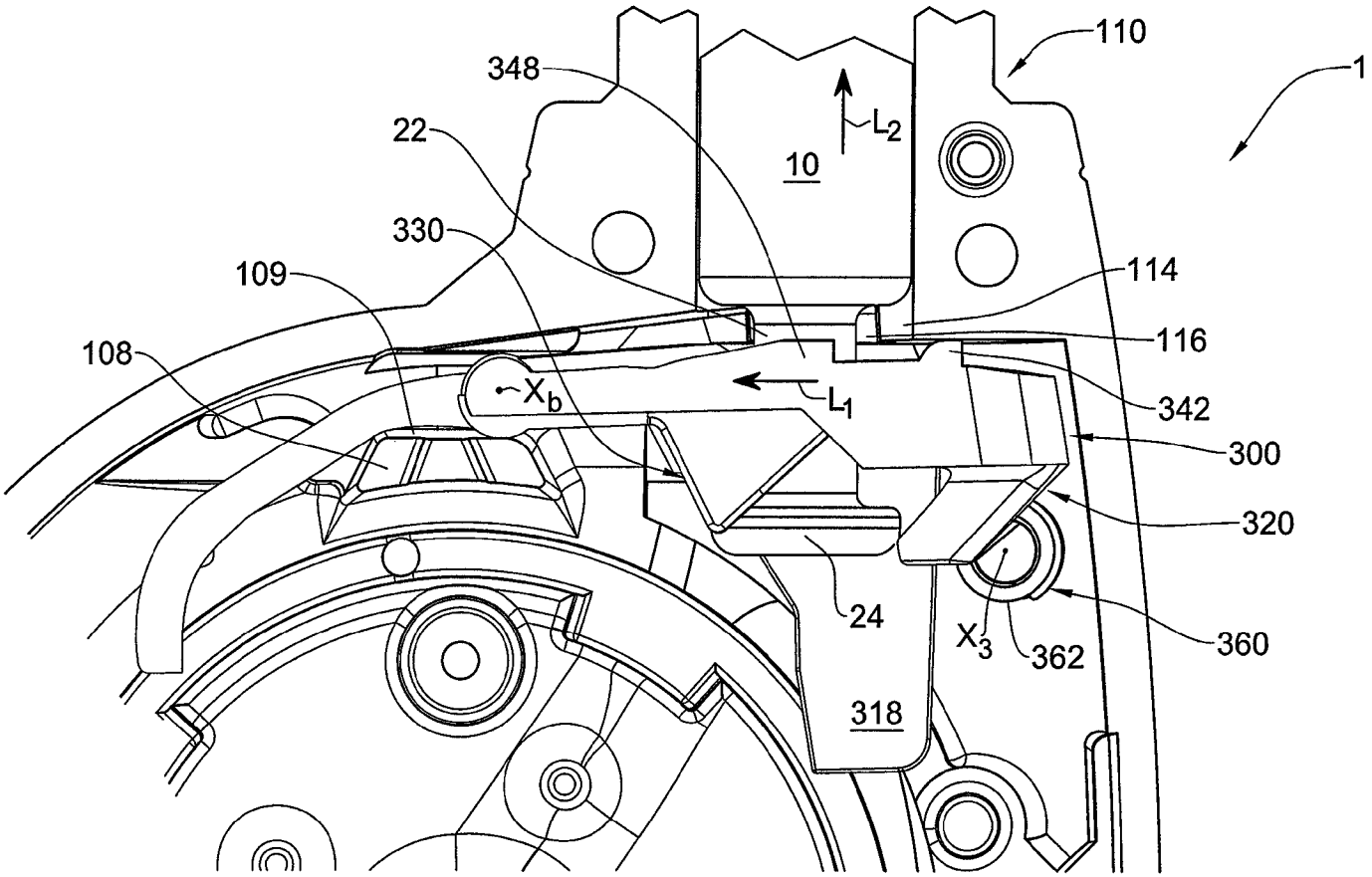
FIGS. 5A, 5C, 5E, 5G, 5I and 5K are schematic front views of the lock shown in FIG. 1 during various stages of dislodging a shank therefrom, shown with a front cover thereof being removed.

It is observed from FIG. 5A that the shank 10 is in the form of a prolonged tubular body 12 and has a locking portion formed with a narrow neck 22 and a circular shank head 24.

Figure 3A:
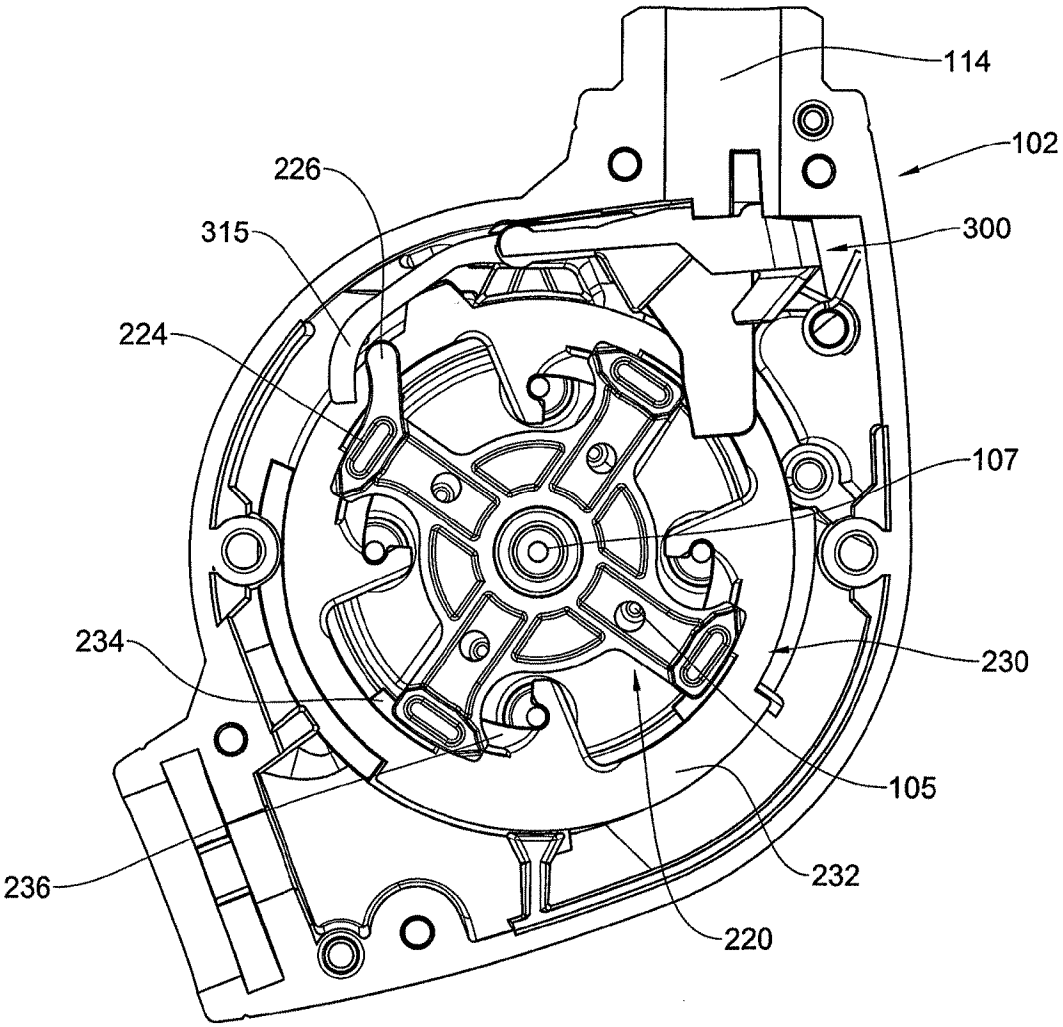
FIG. 3A is a schematic isometric view of the lock shown in FIG. 1, at an open position thereof.
Figure 3B:
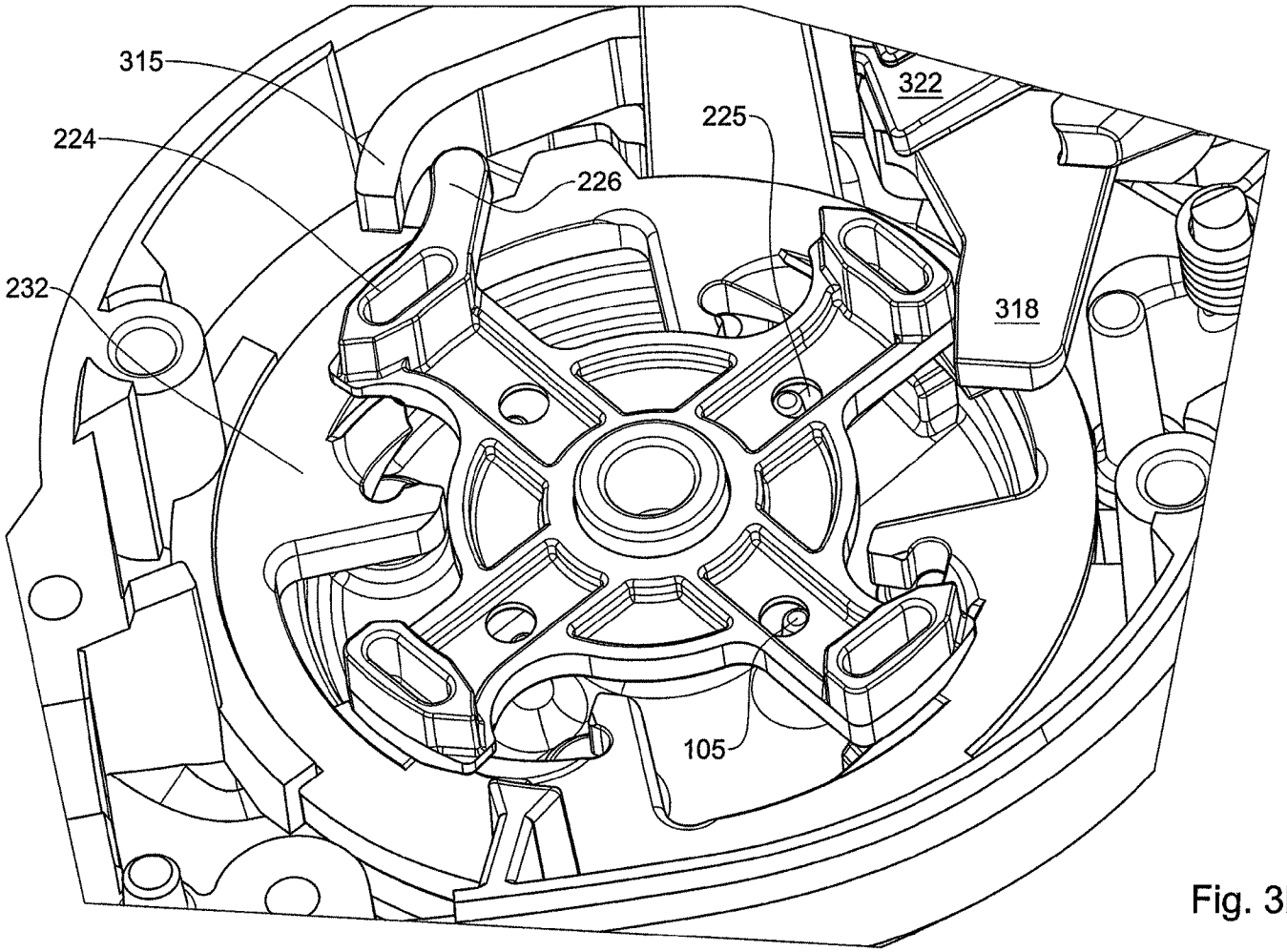
FIG. 3B is a schematic enlarged view of a detail shown in FIG. 3A.

Attention is now drawn to FIGS. 3A and 3B, in which the lock is shown in an open position, in which the bolt member 300 is engaged with the combination mechanism 200.

In particular, in the position shown, four locking holes 225 of the locking cross 220 are suspended over four corresponding spikes 105 of the housing, a portion of the main hub 107 of the housing 102 is received within the main port of the locking cross 220 and the locking cross 220 is resting over a top surface 232 of the decoding ring 230 so that the locking cross 220 is elevated over the bottom surface of the housing cover 102.

The locking cross 220 is formed with four insert portions 224 configured for engagement with the locking discs 240 (shown in FIG. 2). One of the insert portions is formed with an ear-like extension 226 configured, in the above position, for engagement with an extension 315 of the bolt member 300 so that displacement of the bolt member 300 entails rotation of the locking cross 230.

Figure 3C:
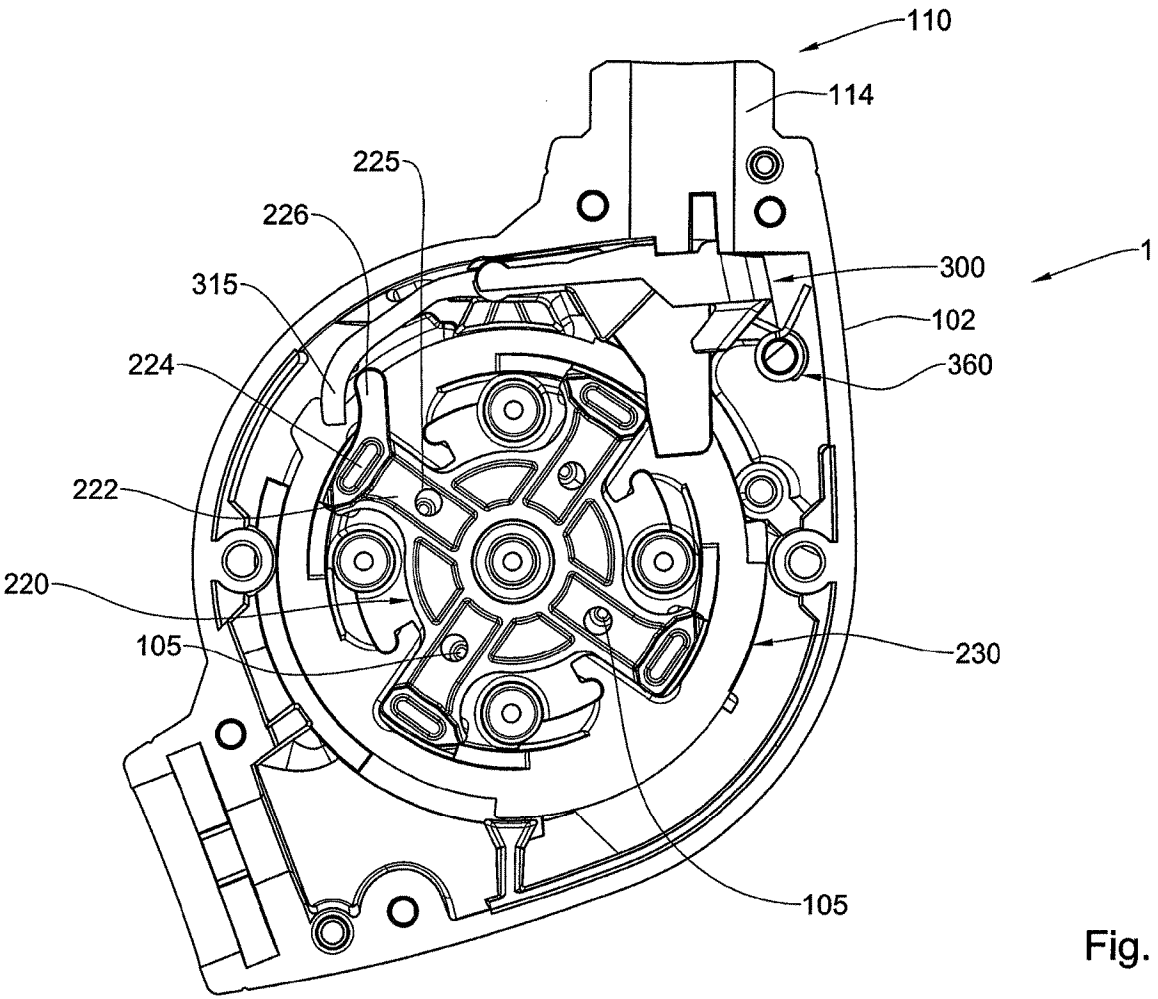
FIG. 3C is a schematic isometric view of the lock shown in FIG. 1, at a resetting position thereof.
Figure 3D:
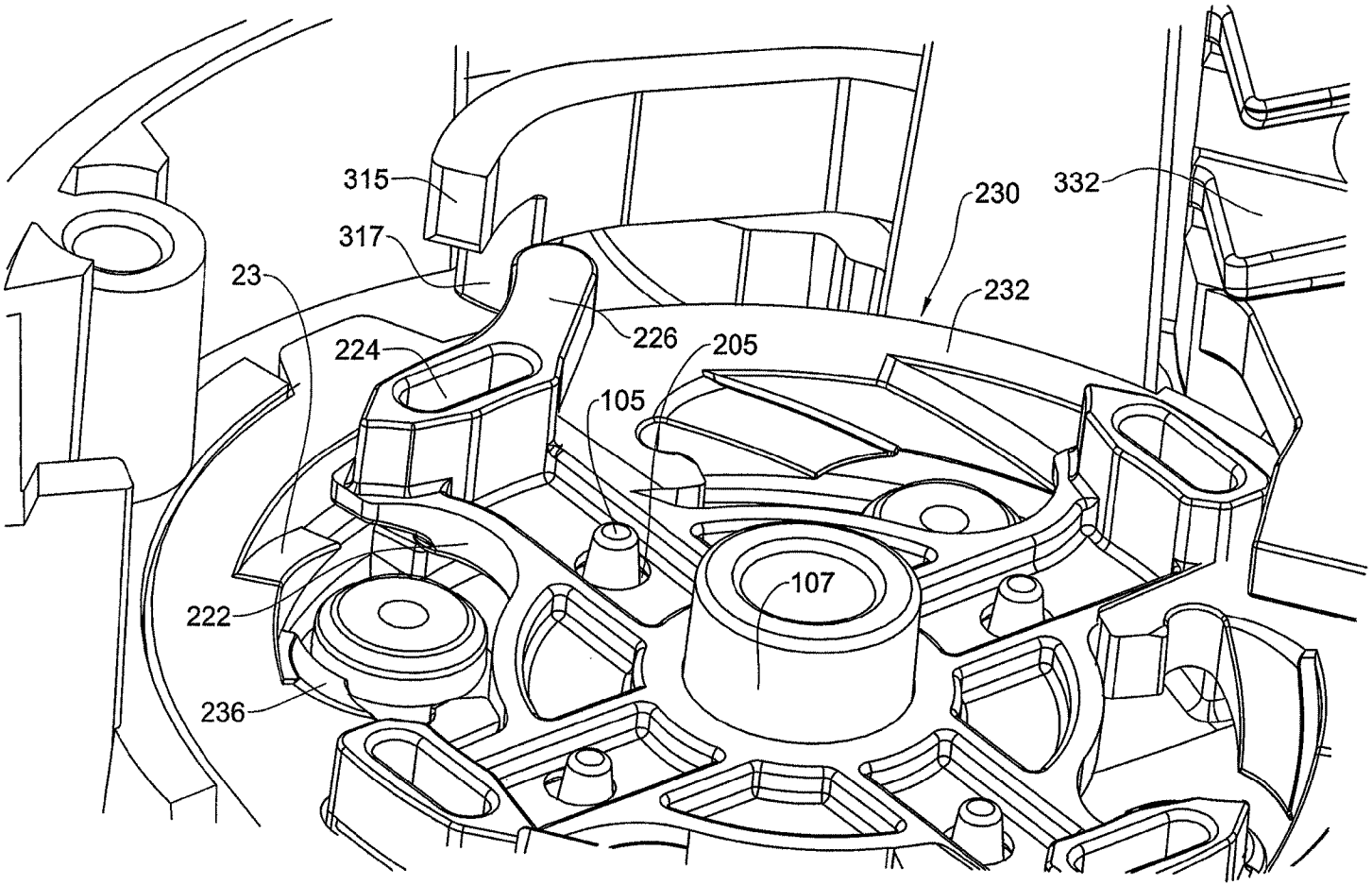
FIG. 3D is a schematic enlarged view of a detail shown in FIG. 3C.

Turning now to FIGS. 3C and 3D, the lock is shown in a reset position, allowing a user to set the combination of the combination lock 1. It is observed that in this position, the decoding ring 230 is angularly rotated with respect to the locking cross 220, allowing the latter to displace downwards (towards the bottom of the cover 102). In this position, the locking cross 220 and the decoding ring 230 are aligned along a common plane.

In the reset position, the locking cross 220 is resting on the bed of the cover 102, so that four spikes 105 of the cover 102 are received within holes 225 of the locking cross 220, thereby preventing rotation thereof.

It is observed that in this position, the extension 315 of the bolt member 300 is disengaged from the ear-like extension 226 of the locking cross 220. Thus, the bolt member 300 is free to perform lateral movement without affecting or influencing the combination mechanism 200 as it simply slides over the locking cross 220, being on an elevated plane with respect thereto.

In order to displace the combination lock from the engaged position shown in FIGS. 3A, 3B to the reset position shown in FIGS. 3C, 3D, the decoding ring 230 is revolved CCW, so that the locking cross 220 slides down the sloped surfaces 234, 236 of the ring 230. When switching backwards to the engaged position, the ring 230 is revolved CW and the sloped surfaces 234, 236 slip under the insert portions 224 of the locking cross 220, thereby elevating the locking cross 220 back to the position shown in FIGS. 3A, 3B.

Turning now to FIGS. 4A to 4F, the bolt member 300 of the present example is made of a single metal body 312 formed with a shaped opening, constituting a shank port having a large diameter portion 314, large enough to receive therethrough the head 24 of the shank 10, and a small diameter portion 316 large enough to receive therethrough the neck portion 22 of the shank 10 but not the head 24. The small diameter portion 316 is surrounded by a blocking surface 311 configured for engagement with the head 24 of the shank 10 for preventing extraction thereof from the housing.

The body 312 is further formed with a lateral extension 315 configured for association of the bolt member 300 with the locking cross 220, and having projecting therefrom an arresting rib 317 configured for preventing the decoding ring 230 from revolving when the lock is in its locked position.

As previously described, the body 312 is formed with an arresting arrangement 340 in the form of two projections 342 projecting from a top side of the bolt member 300. As used herein, the term "projection" may be used interchangeably with "arresting member" of the bolt member 300.

In addition, the body 312 is provided with lock inducing member 320 configured for engagement with the shank 10 during its insertion into the housing, so that the bolt member 300 is displaced into a securing position, preventing extraction of the shank 10.

In particular, the lock inducing member is in the form of an operative projection 322 extending at an angle from a bottom side of the body 312 so as to partially obscure the large diameter opening 314.

In operation, upon insertion of the head portion 24 of the shank 10 through the large diameter opening 314, the head 24 engages the operative surface 324, constituting a locking surface, of the lock inducing member 320 thereby first applying as load to the bolt member 300 in a downwards direction, sufficient for pivoting the bolt member 300 in a CW direction about axis $X_b$ (shown in FIGS. 5A to 5L), thereby removing the projection 342 from the recess 116 to disengage the bolt member 300 from the housing 102. As used herein, the term "recess" may be used interchangeably with the term "arresting portion" of the housing 102.

Figure 4A:
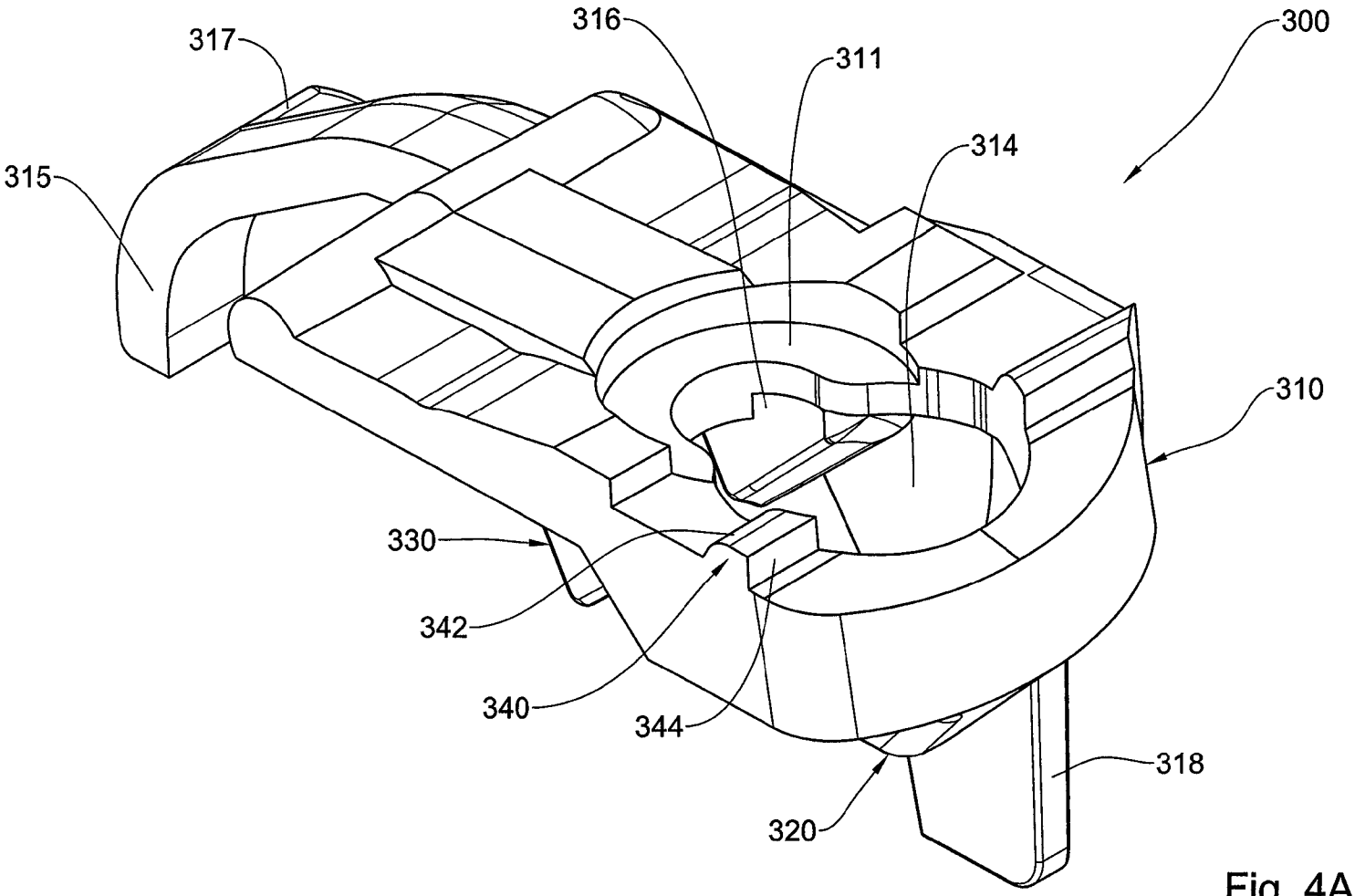
FIGS. 4A to 4D are schematic top isometric, side, top and bottom isometric views of a bolt configured for use with the lock shown in FIGS. 1 to 3D.
Figure 4B:
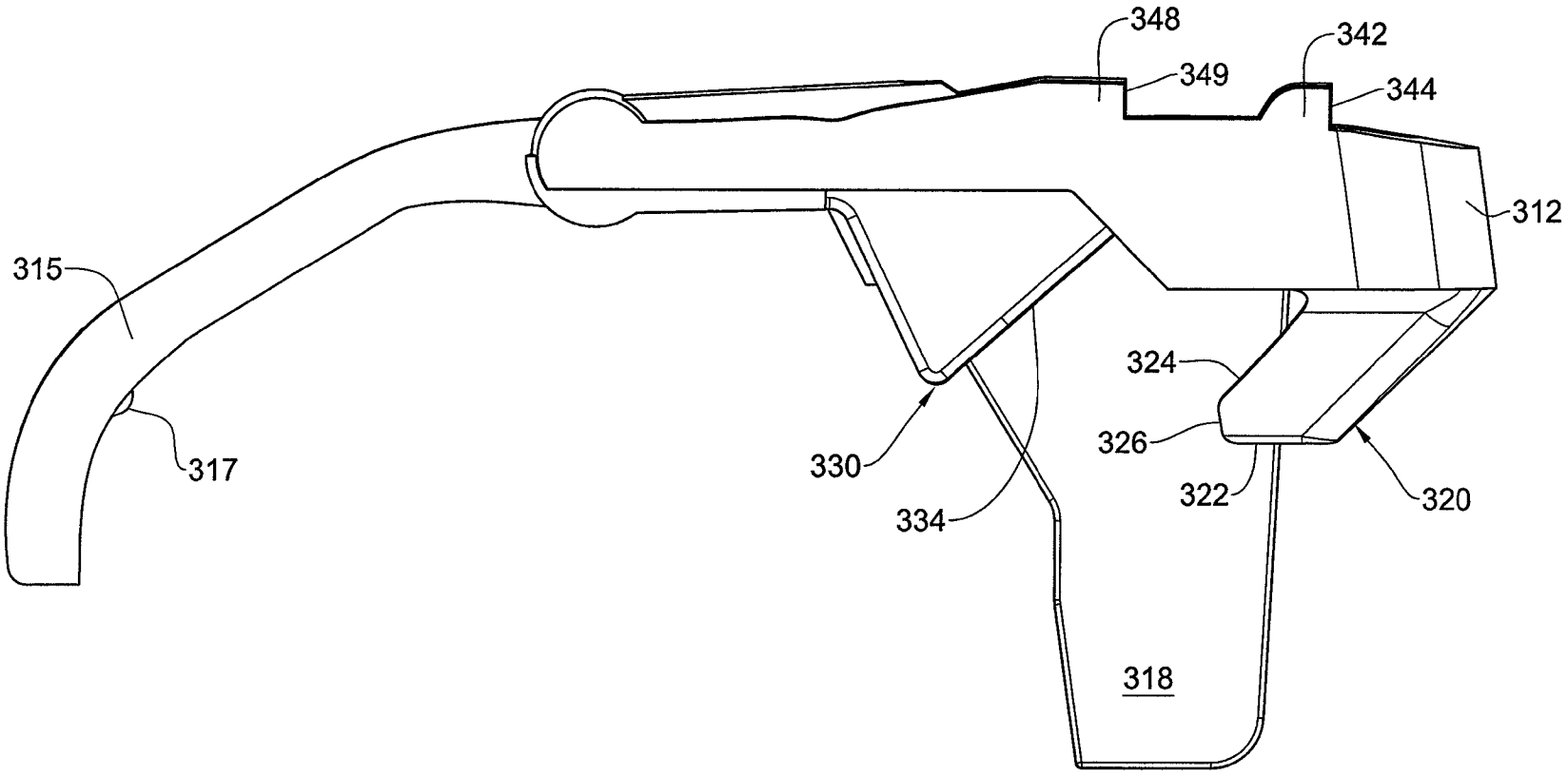
Figure 4C:
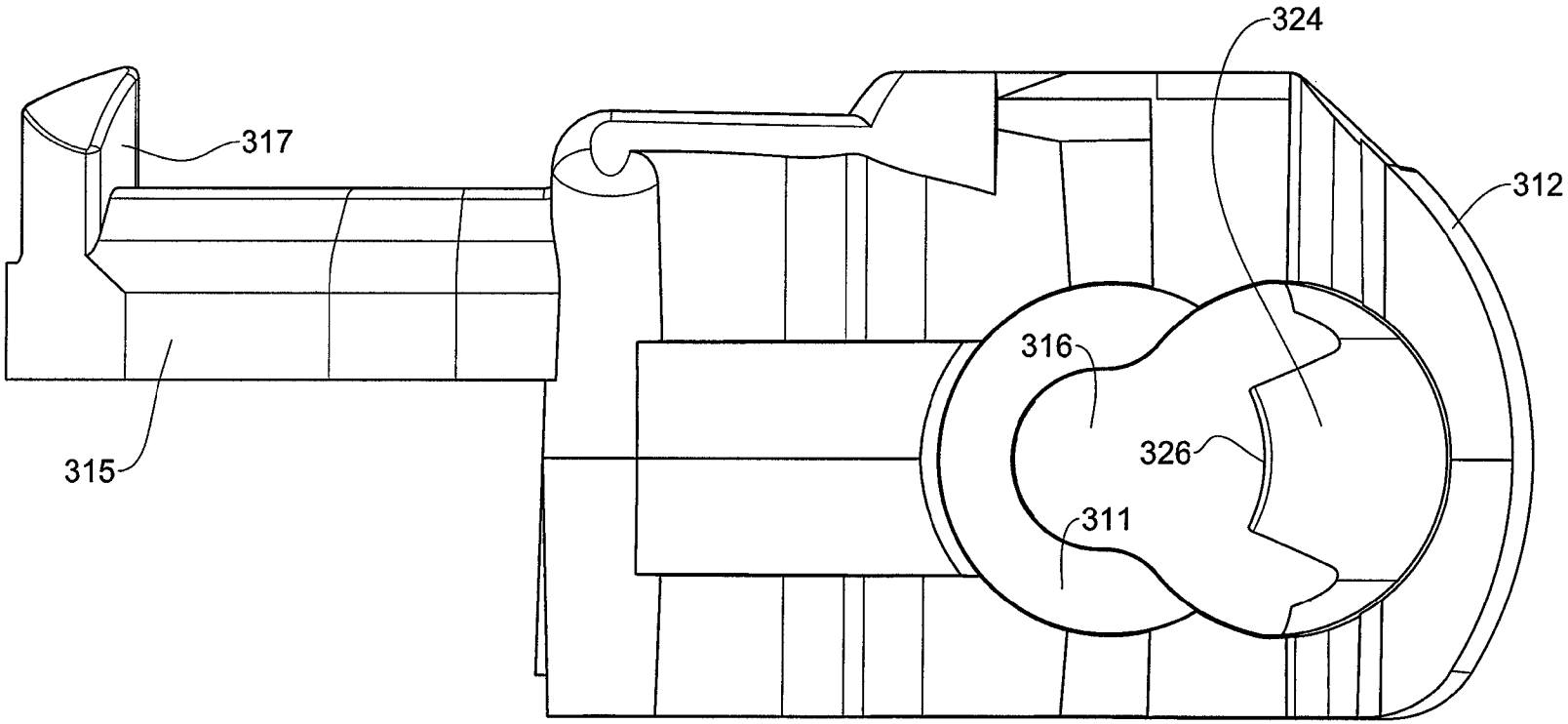
Figure 4D:
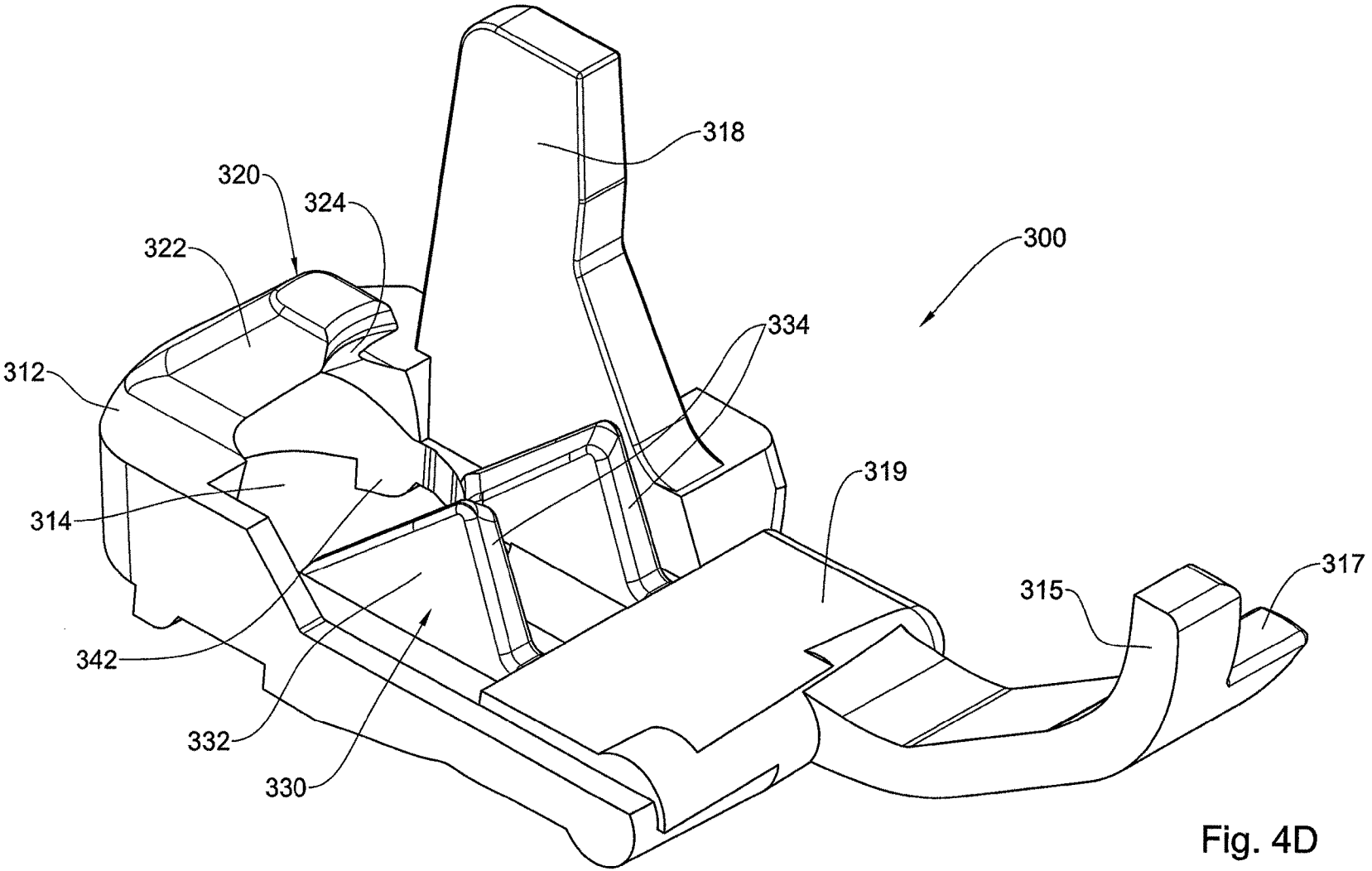
Figure 4E:
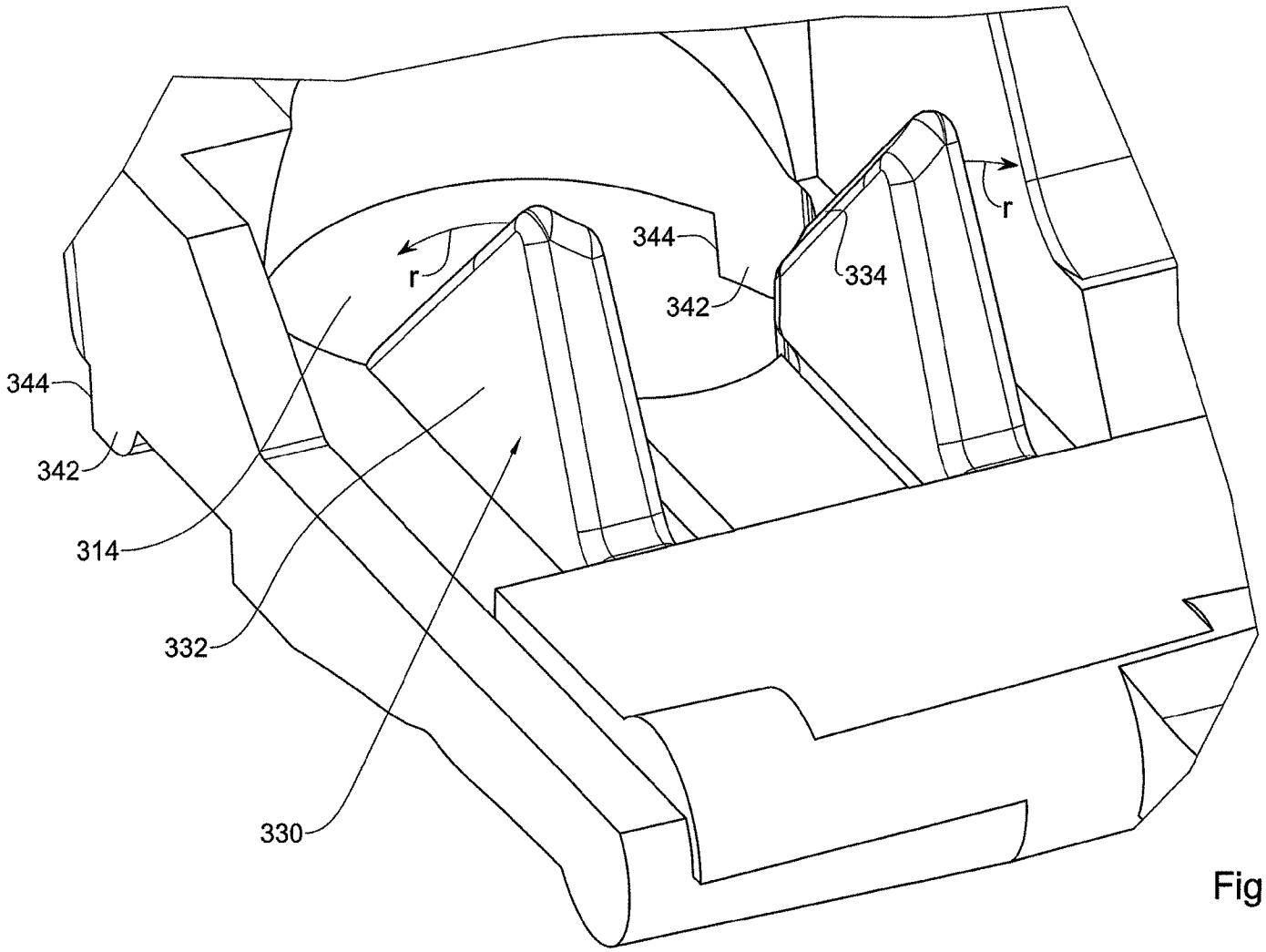
FIG. 4E is a schematic enlarged view of a detail of the lock shown in FIG. 3D.
Figure 4F:
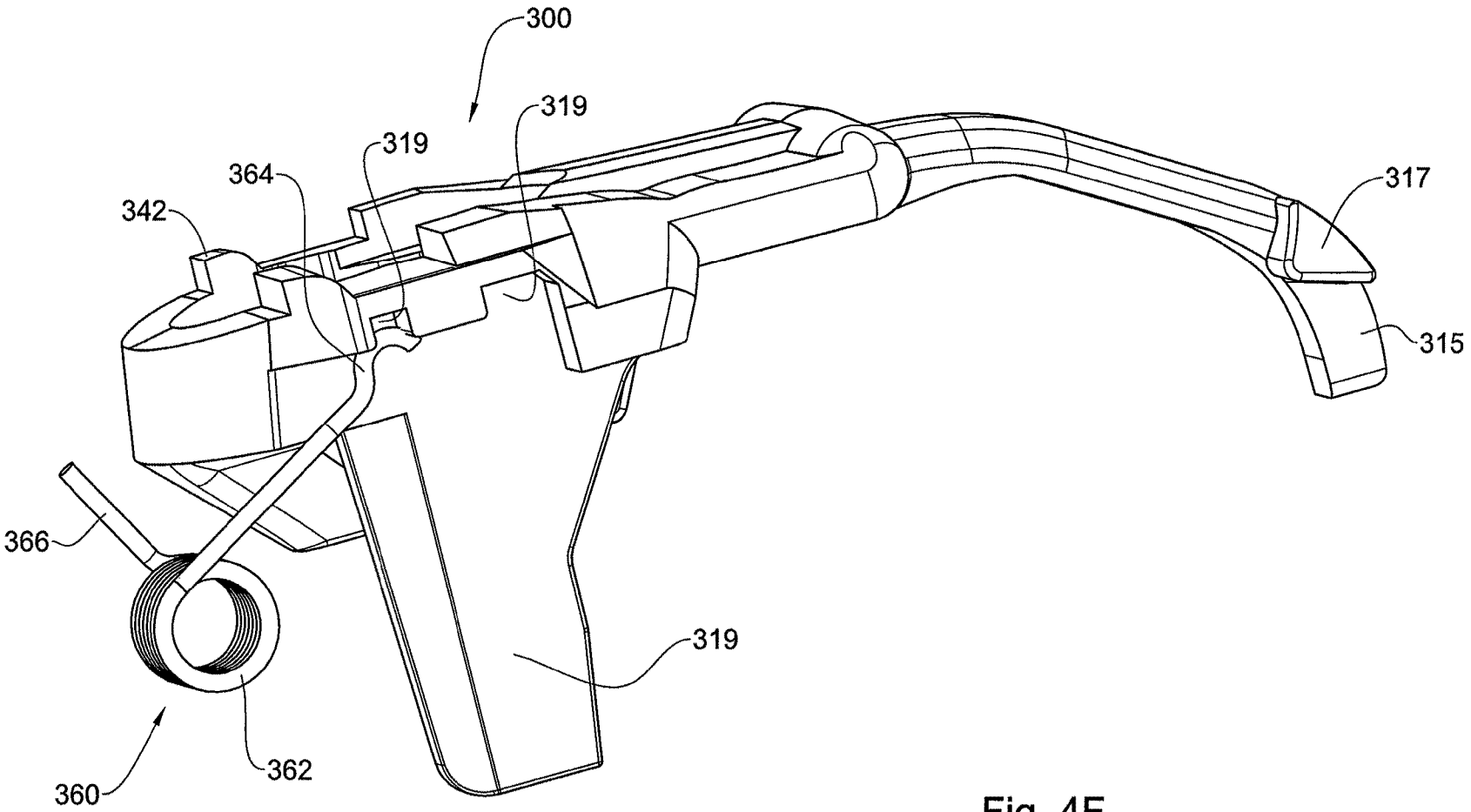
FIG. 4F is a schematic rear isometric view of the bolt shown in FIGS. 4A to 4E, when in engagement with a biasing spring.

Consecutively, as the shank 10 cannot displace laterally with respect to the lock port 110 of the lock, the load to the surface 324 results in lateral displacement of the lock member 300 in a rightward direction (directions refer to the view shown in FIG. 4B). The bolt member 300 is free to perform such displacement since it is now disengaged from the housing 102 (the projection 342 is out of the recess 116).

This lateral displacement of the bolt member 300 brings the small diameter opening to engage and lock against the neck portion 22 of the shank 10, thereby preventing its extraction from the housing of the lock 1.

The bolt member 300 is also formed with an opening inducing arrangement 330, configured, when the shank 10 is received within the lock 1 to engage with the head 24 in order to displace the bolt member 300 into a position allowing extraction of the shank 10 from the housing (provided that the proper combination has been set in the combination mechanism 200).

The opening inducing arrangement 330 is in the form of two spaced apart ribs 332 extending downwards from the body 312, each being formed with an operative surface 334, constituting an unlocking surface of an opposite orientation to that of the operative surface 324 of the lock inducing member 320.

In operation, upon extraction and/or pulling on the shank 10 attempting to remove it from the housing of the lock 1, the operative surfaces 334 are configured for engaging the head 24 of the shank 10 and, due to their slanted orientation, to entail displacement of the bolt member 300 in an opposite lateral direction (leftwards), in a manner similar to that described previously with respect to the lock inducing member 320.

Upon such engagement, the head 24 slides along the operative surfaces 334 and, as the shank 10 cannot displace laterally with respect to the port 110 of the lock 1, it applies a load to the bolt member 300 via the ribs 332, entailing the required lateral displacement.

However, as will be explained with respect to FIGS. 6A and 6B, the ribs 332 are configured for deforming and collapsing under the application of a predetermined amount of load thereto. In particular, it is observed that the surfaces 334 are not only slanted but are also tilted, so that in engagement with the head 24 of the shank 10, the latter applies a force thereto attempting to part the ribs in the direction shown by arrows r. When the force applied by the head 24 is greater than the predetermined force, the ribs 332 will simply collapse, deforming outwards in the direction of arrows r.

Turning now to FIGS. 5A to 5L, a sequence is shown in which the combination of the combination lock 1 is properly set and the shank 10 is allowed to be dislodge from the lock port 110.

It is observed that the locking port 110 is formed therein with two longitudinal recesses 116 configured for receiving therein the arresting projection 342 when the bolt member is in the above given position.

The bolt member 300 is in association with a biasing arrangement 360 (spring loaded) constituted by a spring 362 configured for constantly applying an angular force in a CW direction about axis $X_S$.

Figure 5B:
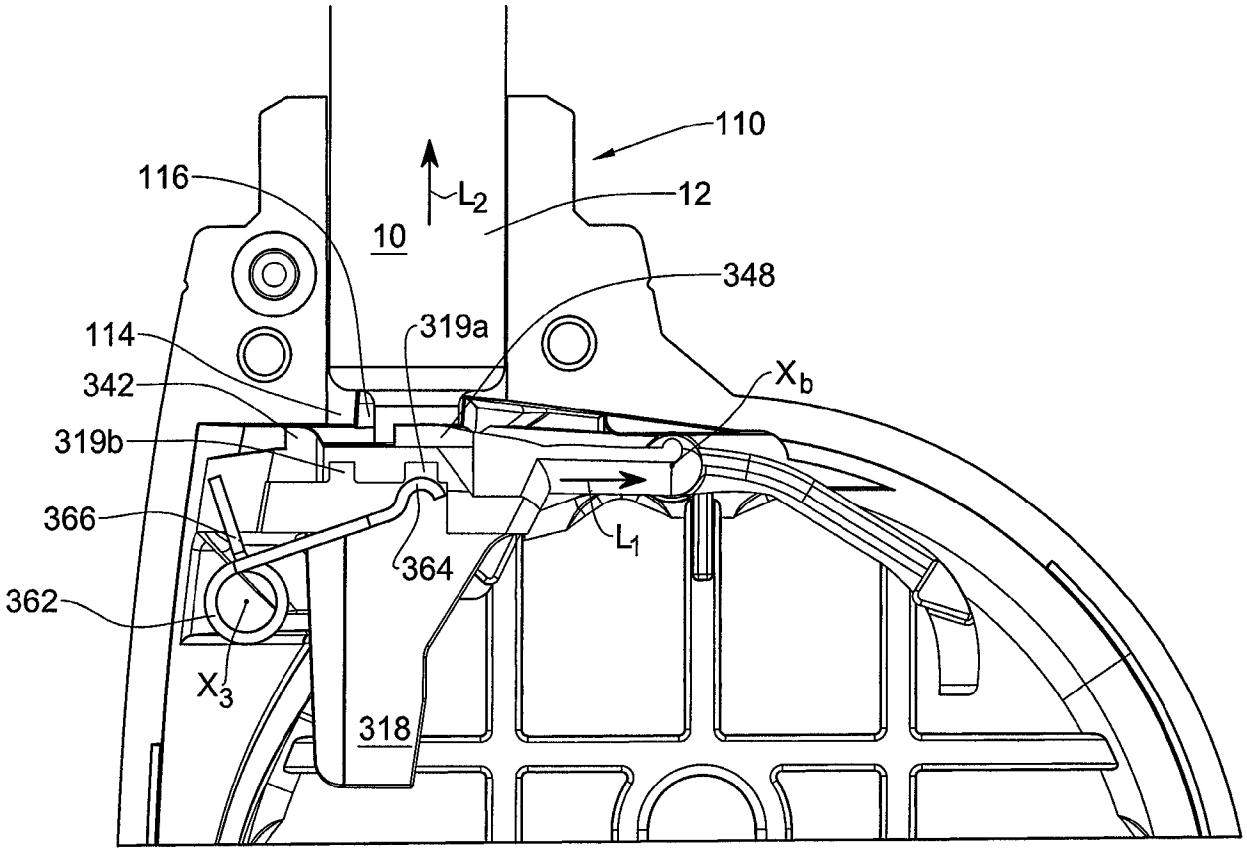
FIGS. 5B, 5D, 5F, 5H, 5J and 5L are schematic rear views of the lock shown in FIGS. 5A, 5C, 5E, 5G, 5I and 5K, shown with a rear cover thereof being removed.

In particular, in FIGS. 5A and 5B, the shank head 24 is shown in engagement with the ribs 332 of the opening inducing arrangement 330. Thus, pulling on the shank 10 in an upward direction indicated by arrow L2, will entail lateral displacement of the bolt member 300 leftwards in the lateral direction indicated by arrow L1.

It is further observed that a first end 364 of the biasing spring 362 is received within a first nook 319*a* of the bolt member 300, urging it in an upward direction, so that during the above lateral displacement, the bolt member 300 maintains its orientation and displaces against the force of the biasing spring 362.

Also, in the above position, two projections 342 of the bolt member 300 (located one behind the other), extending from a top side thereof facing the locking port 110, abut an undersurface of the lock port 110 and slide therealong.

Figure 5C:
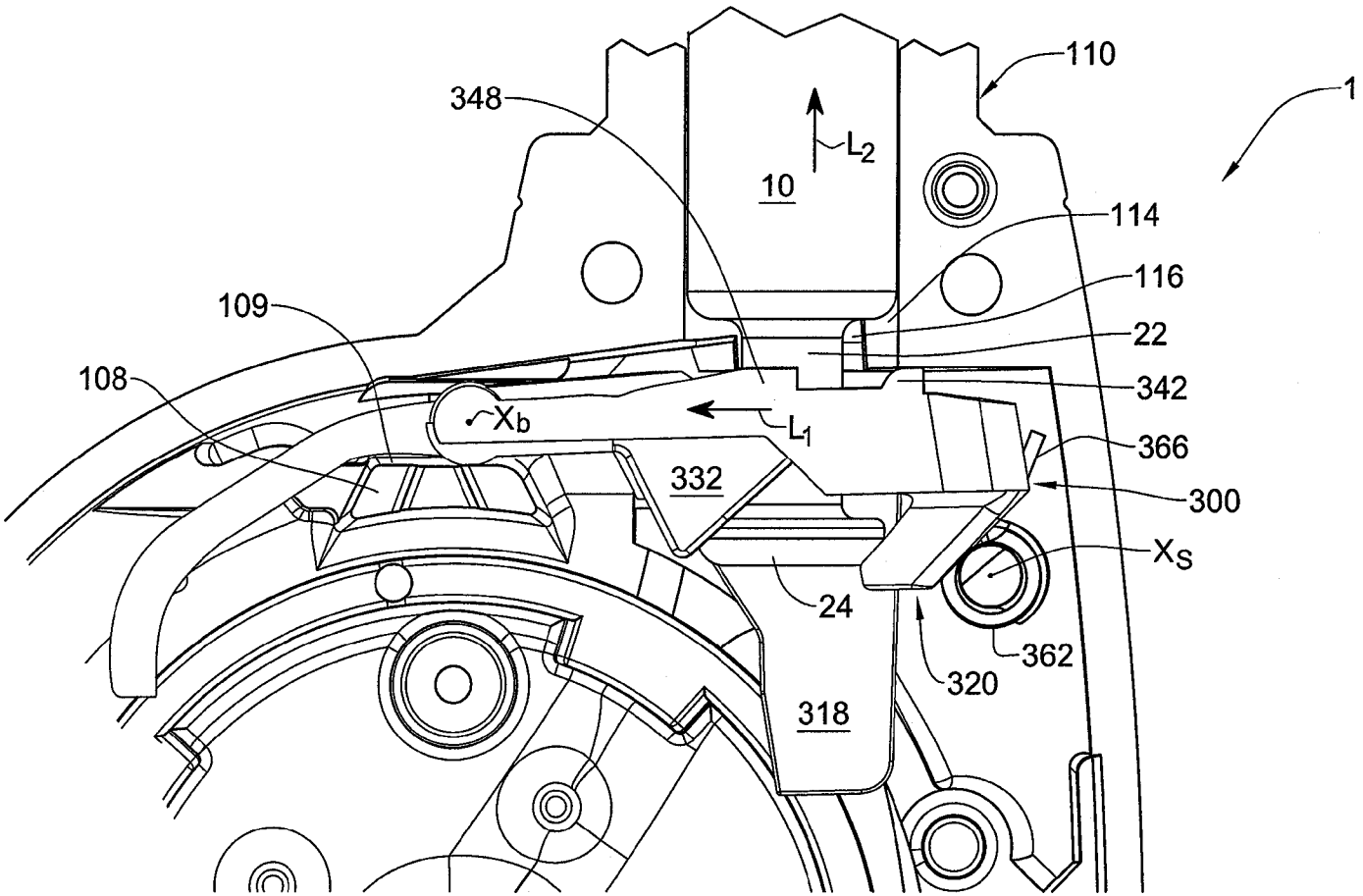
Figure 5D:
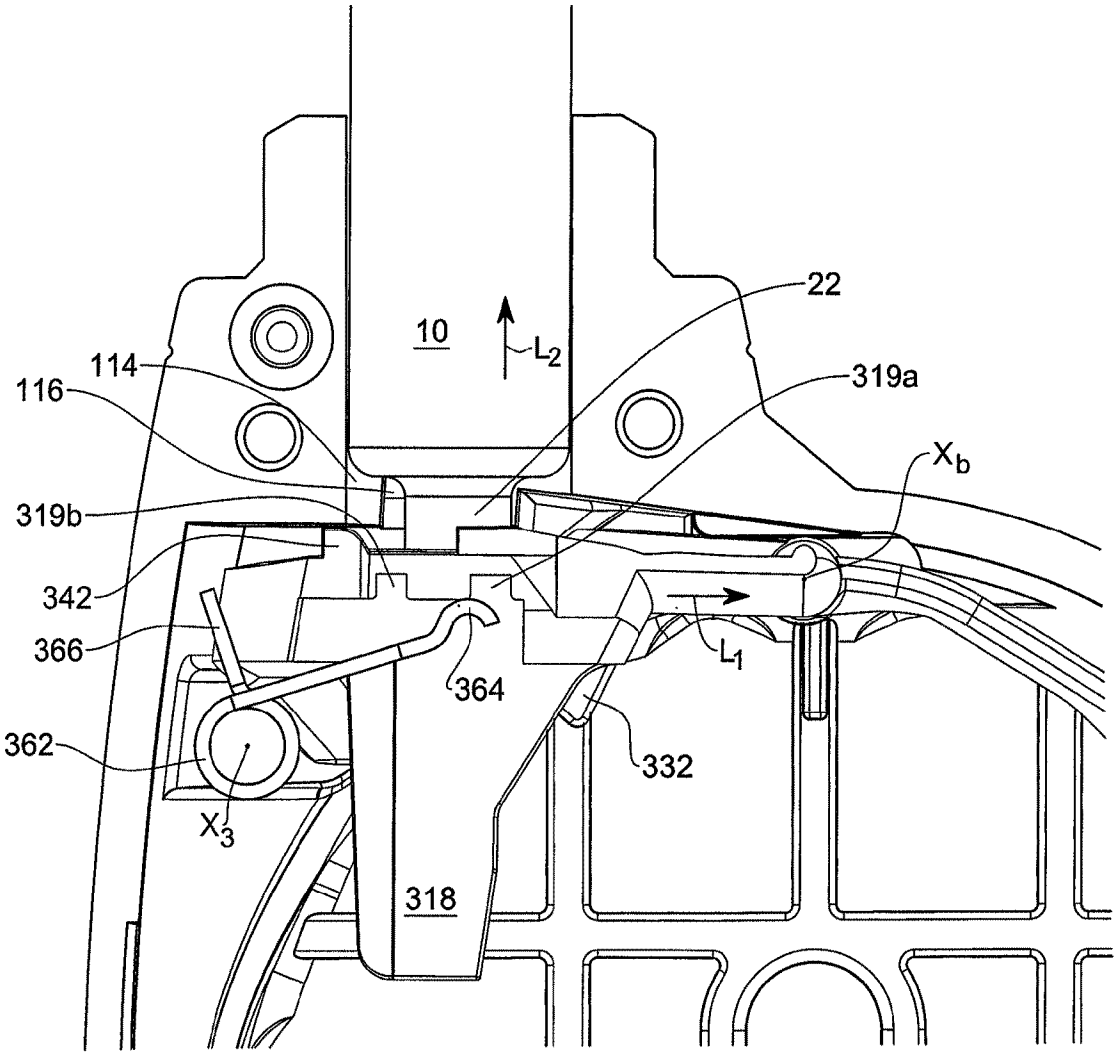

Turning now to FIGS. 5C and 5D, upon further displacement of the shank 10 in direction L2, the bolt member 300 displaces further laterally so that the end 364 slides out of the nook 319*a* and is pressed under a wall portion of the bolt member 300.

Figure 5E:
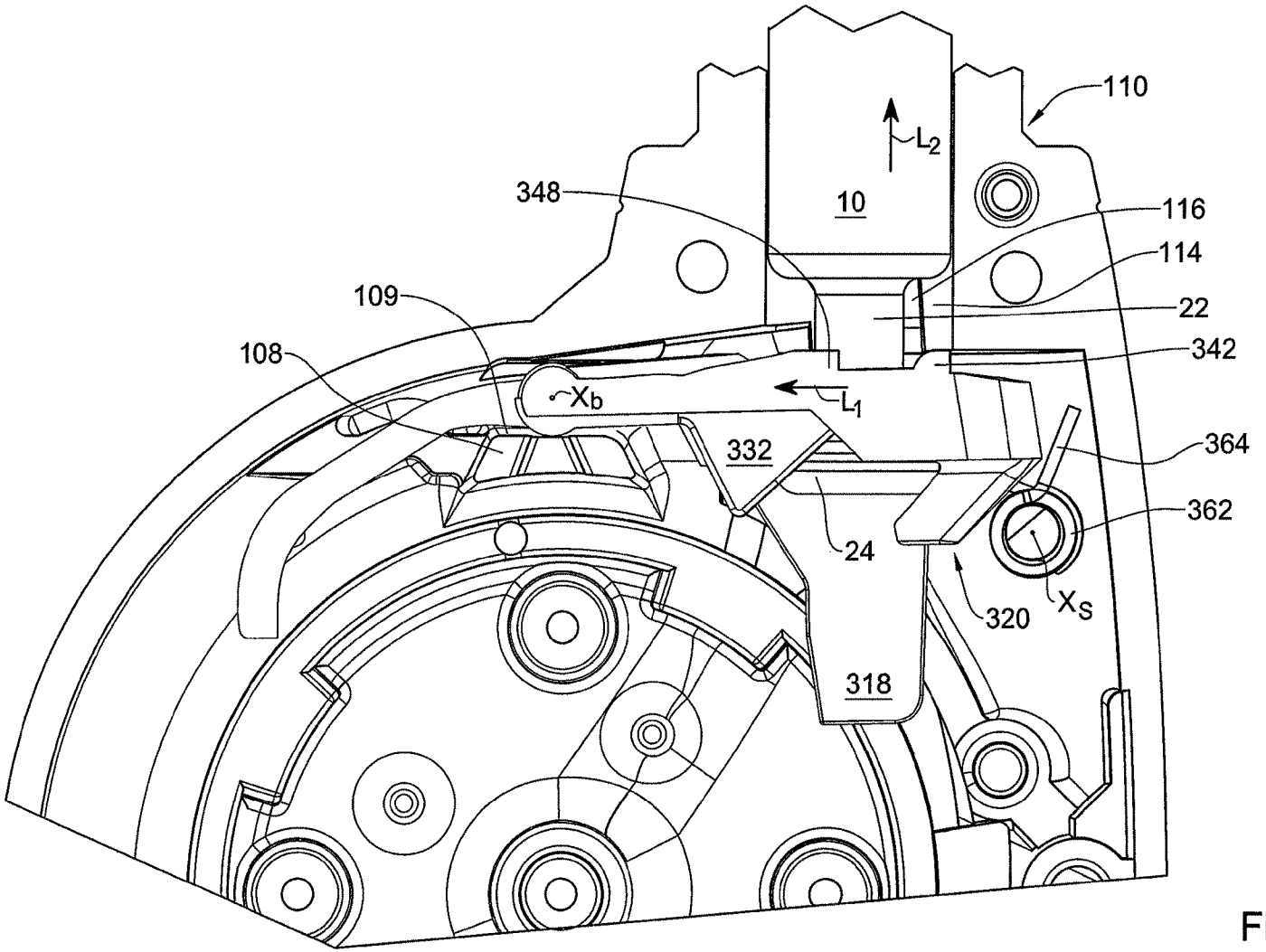
Figure 5F:
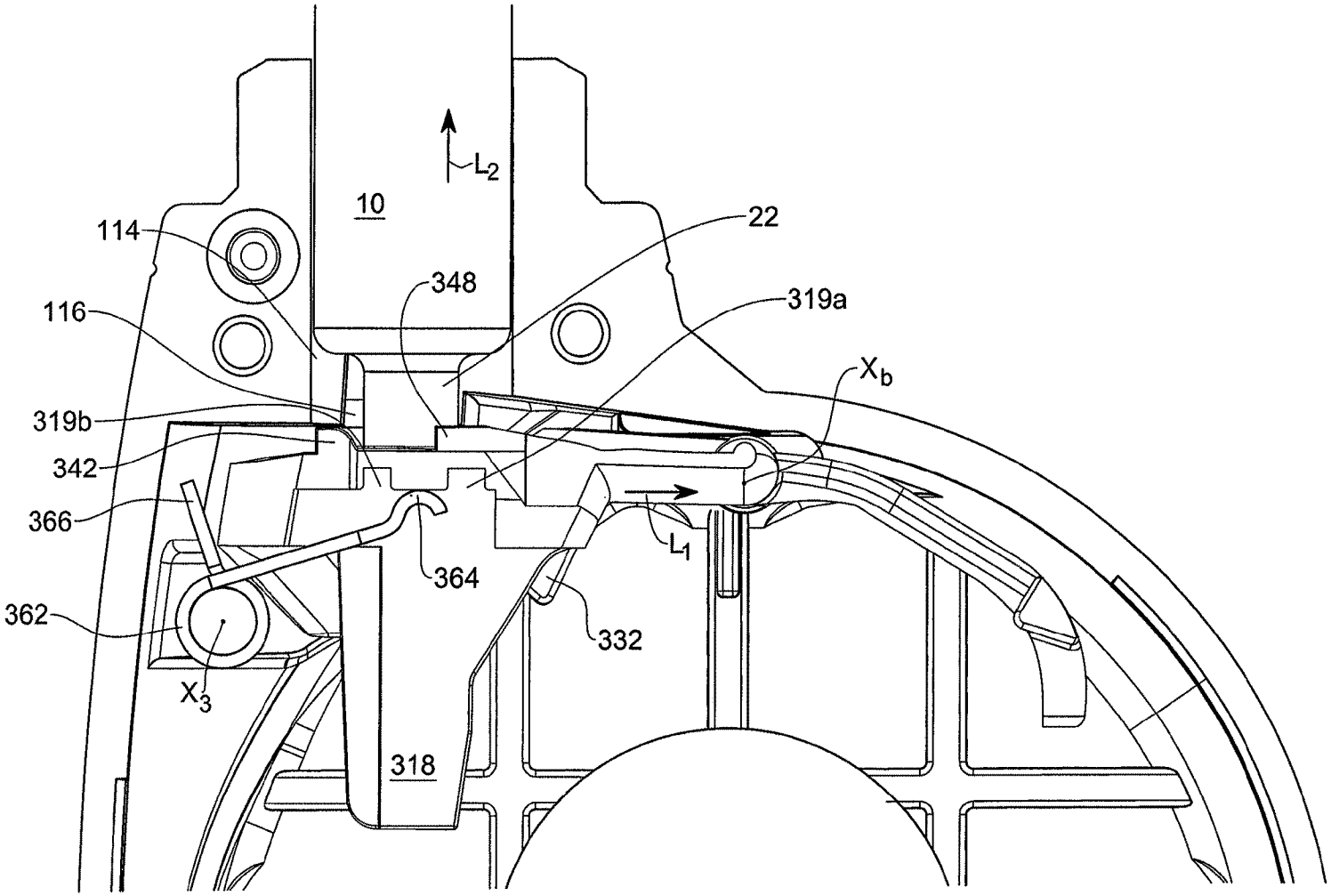
Figure 5G:
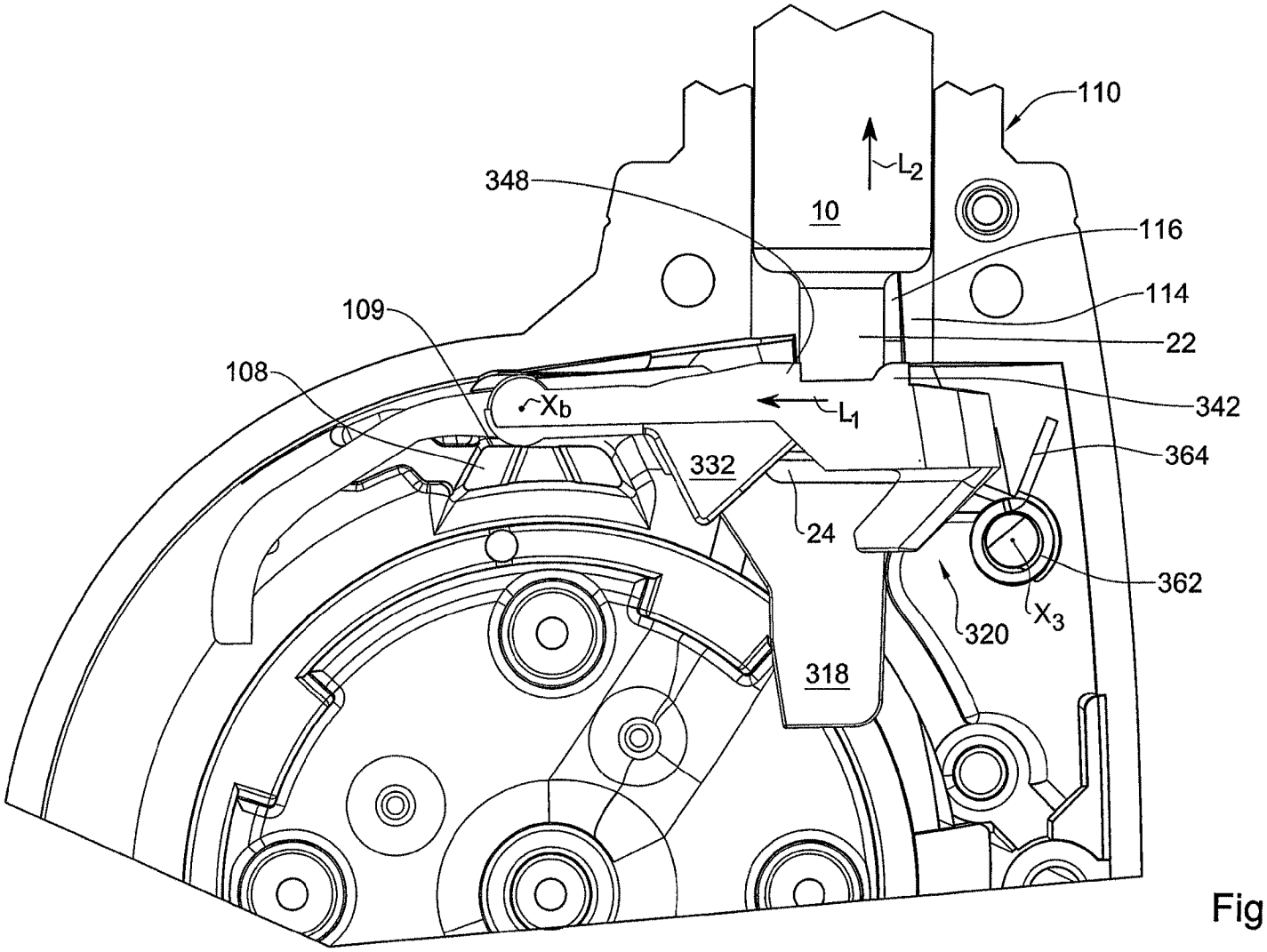
Figure 5H:
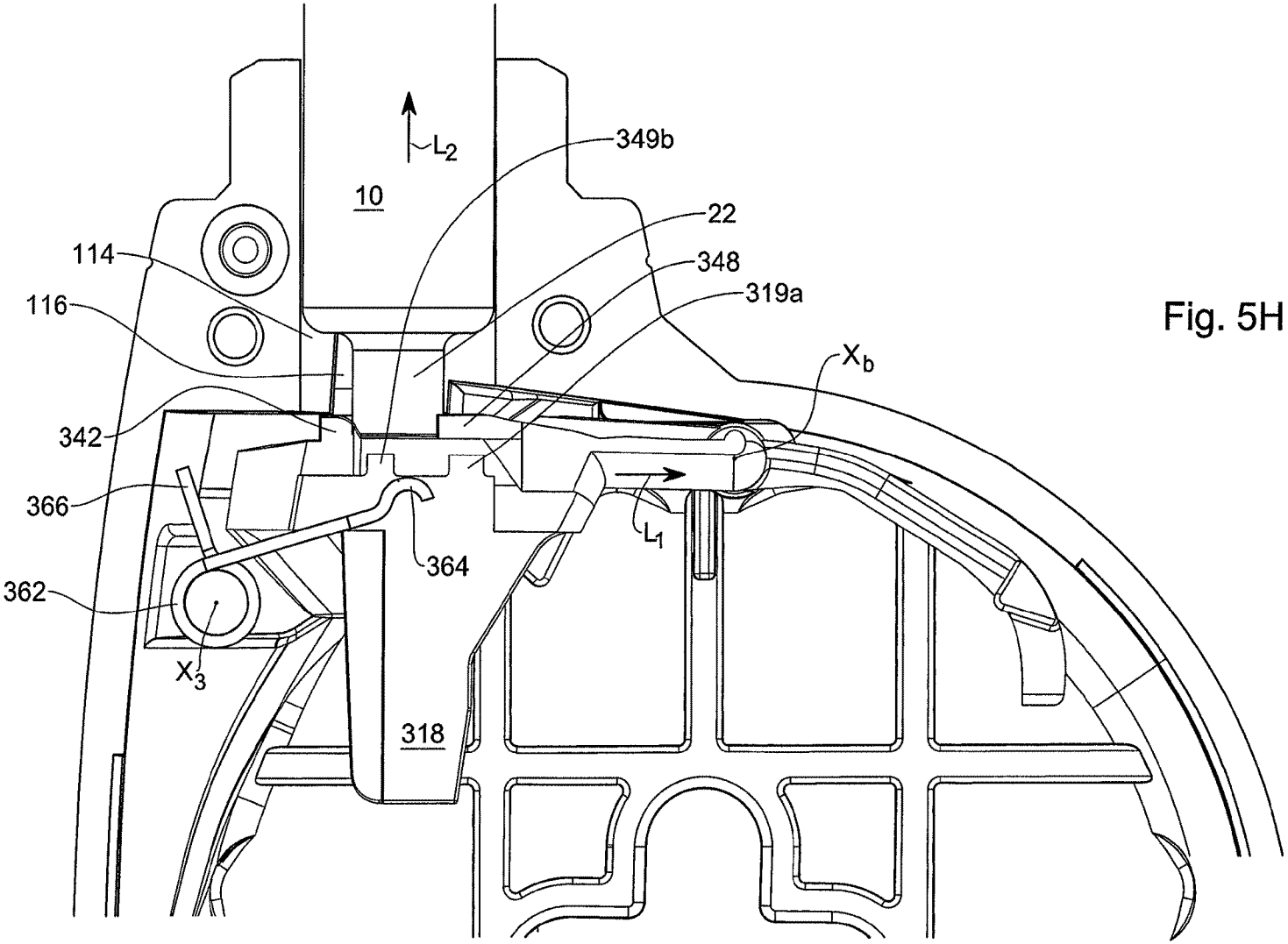
Figure 5I:
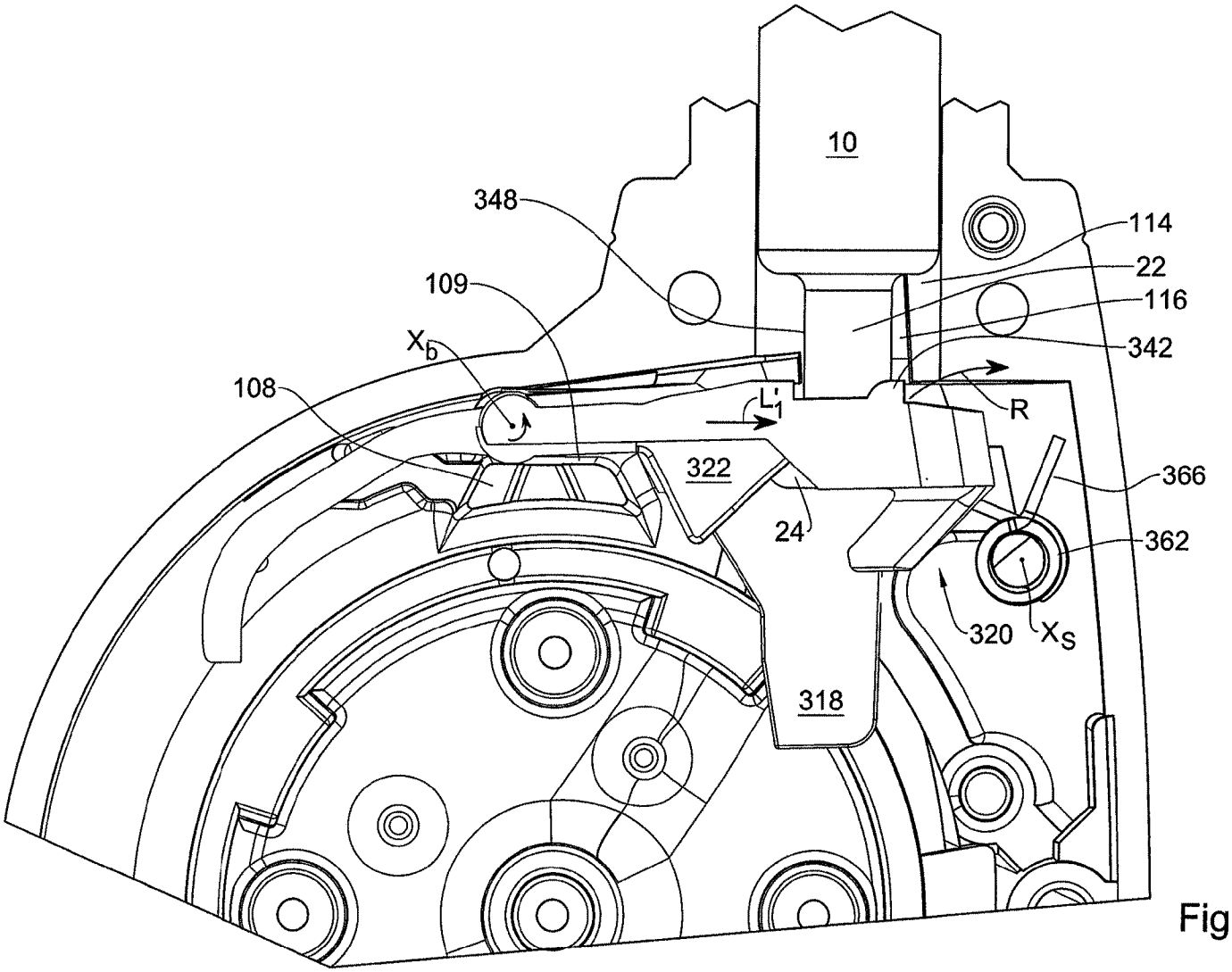
Figure 5J:
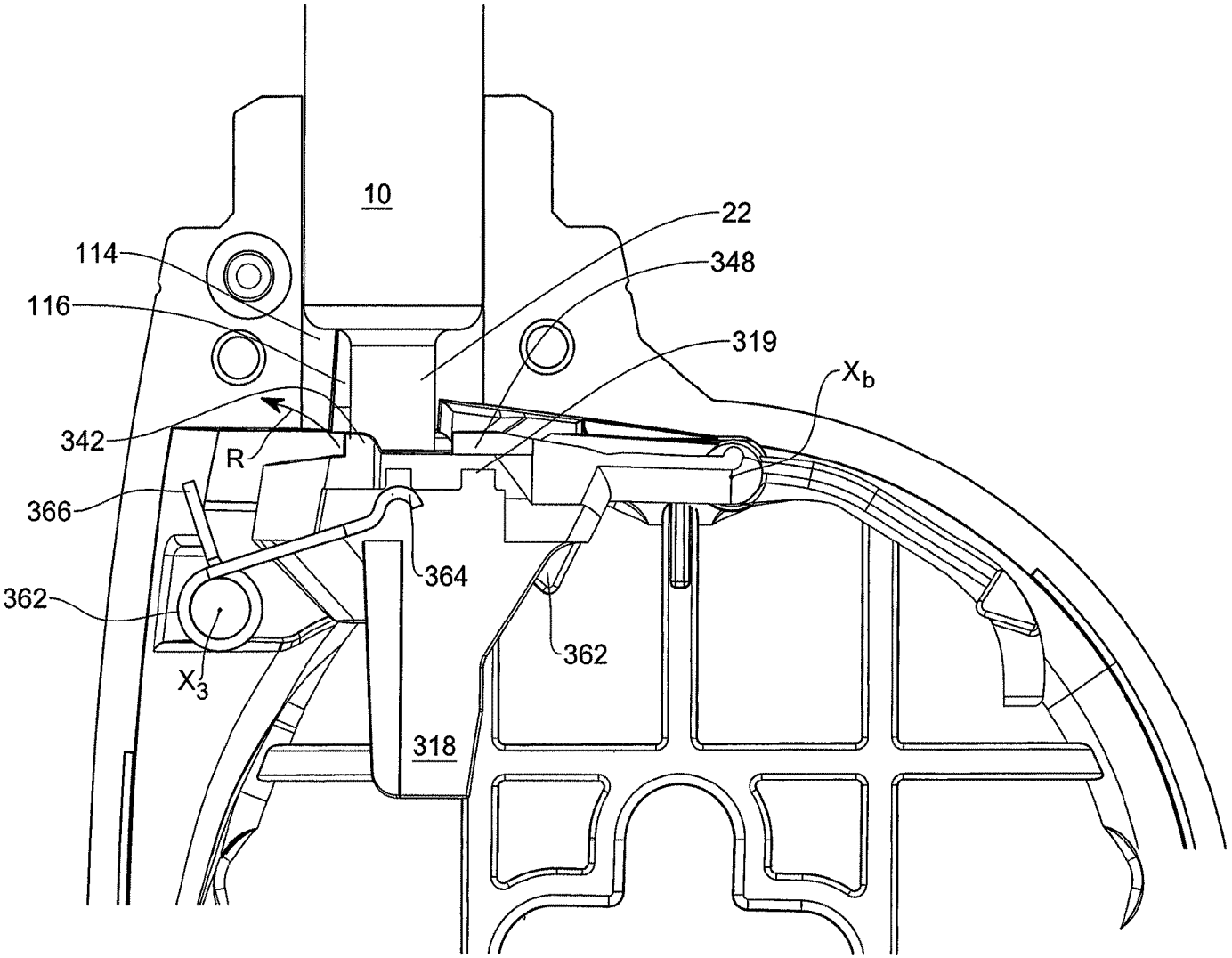

As the bolt member 300 progresses laterally in direction L1 as shown in FIGS. 5E and 5F, the projection 342 of the bolt member 300 draws closer to the recess 116 of the lock port 110 until it reaches the position shown in FIGS. 5G and 5H.

In this position, the tip of the projection 342 is exactly at the entrance to the recess 116. In principle, the design may be such that at this stage, the head 24 of the shank 10 disengages from the operative surfaces 334 of the ribs 332 so that its displacement in direction L2 does not entail further displacement in direction L1. However, it is appreciated that in order to make sure that the projection 342 is received within the recess 116, the design is such that the bolt member 300 continues to displace laterally beyond the recess 116 to the position shown in FIGS. 5I and 5J.

In the above position, the end 364 of the spring 362 has slipped into the second nook 319*b* of the bolt member 300 and is still attempting to rotate about its own axis $X_S$ in a CW direction. As a result, the bolt member 300, having a sliding pivot point at $X_b$, performs a combined displacement in which it slides laterally in direction $L_1'$ (opposite to L1) and simultaneously performs angular/pivotal displacement in a CCW direction about the axis $X_b$.

Figure 5K:
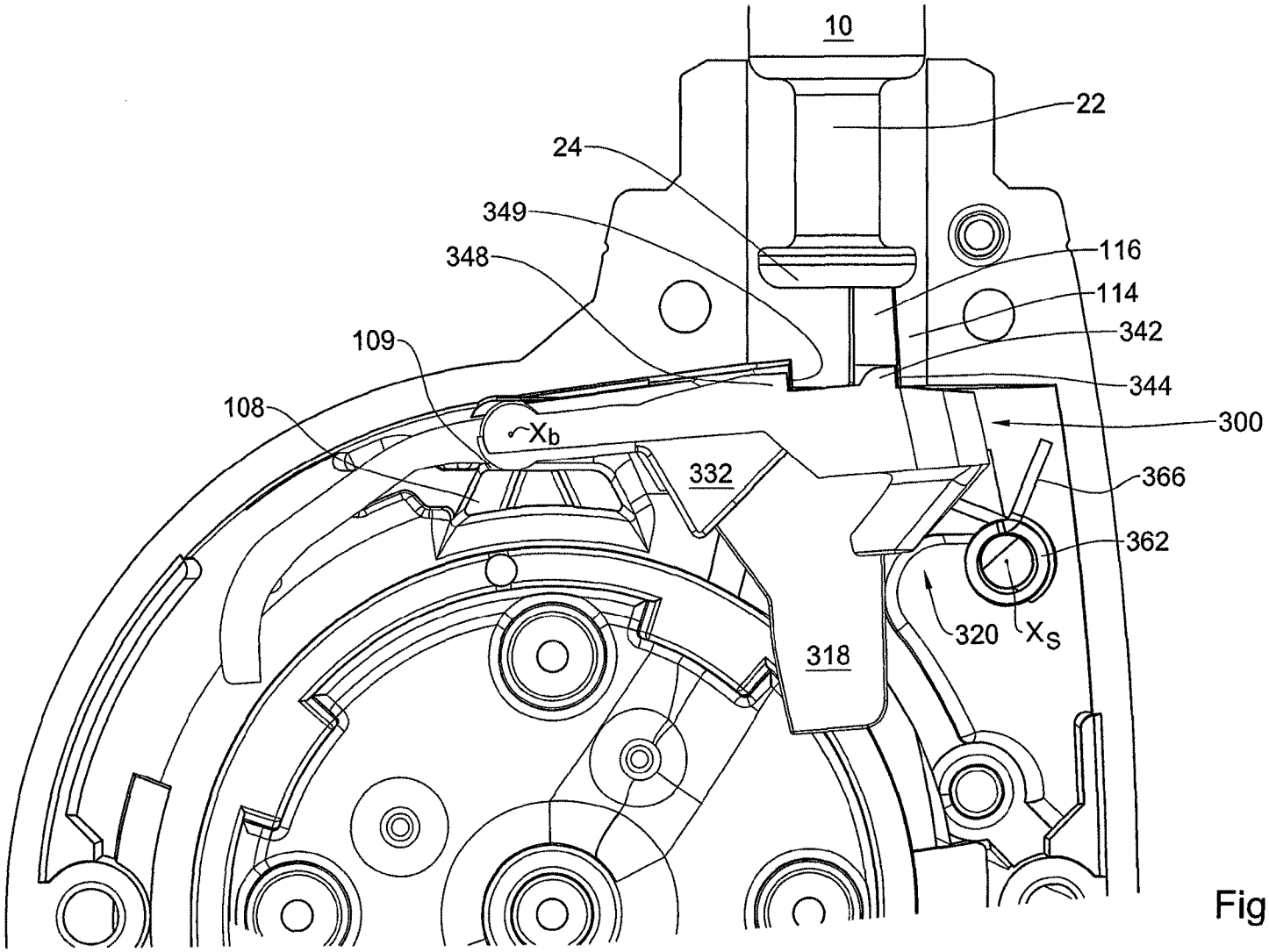
Figure 5L:
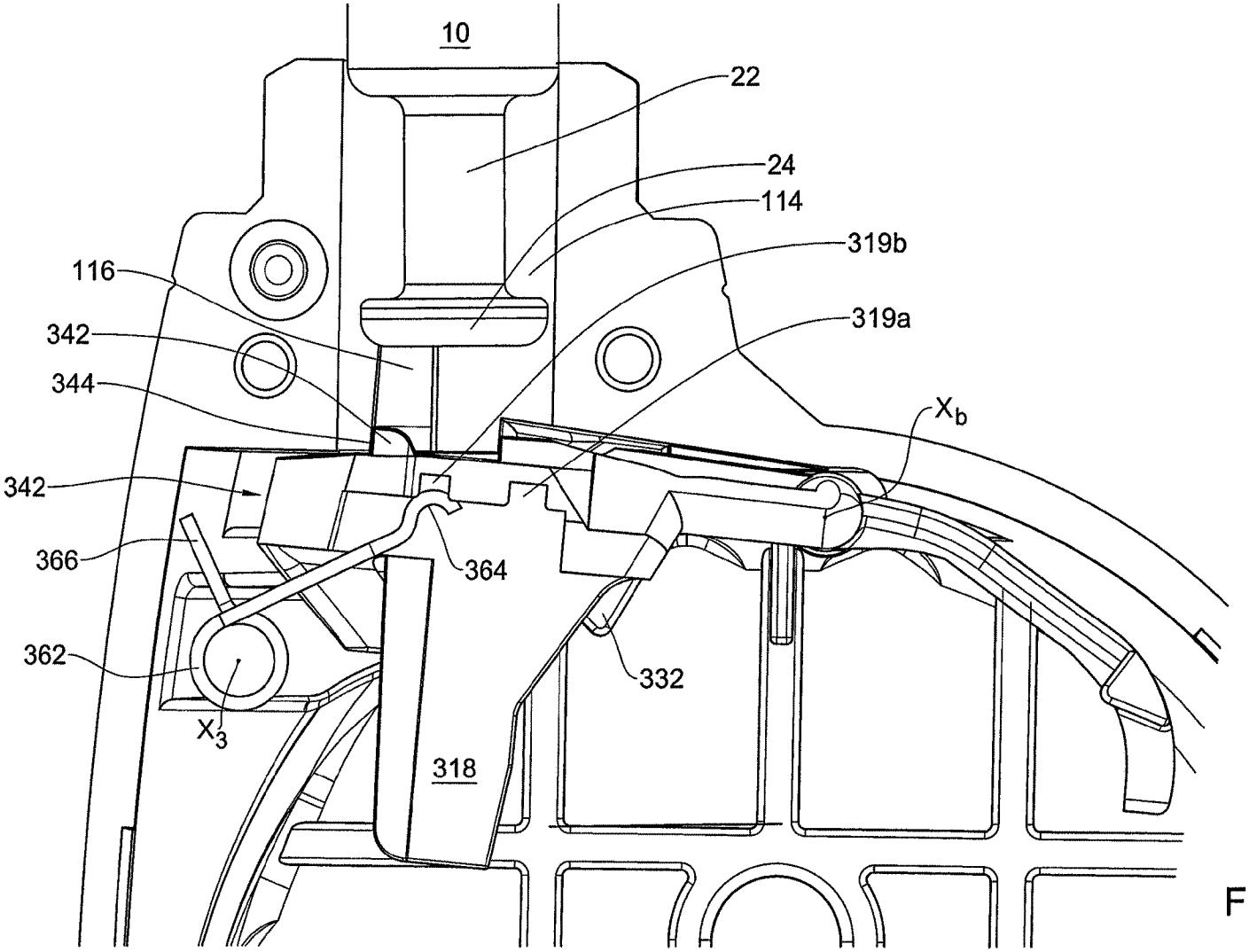

The above displacement results in the projection 342 displacing towards the recess 116 so that the surface 344 thereof becomes pressed against the surface of the recess 116 as shown in FIGS. 5K and 5L. In this position, the projection 342 of the bolt member 300 is firmly lodged within the recess 116 and is held in place by the force of the biasing spring 362.

As the bolt member 300 is mechanically associated with the combination mechanism 200 (as will be explained in detail later), it is imperative, in the given position, to prevent displacement of the bolt member 300 in order to prevent shifting the combination mechanism 200 out of its unlocking combination, which may render the combination lock disabled or impossible to re-use.

Thus, even in case of the lock experiencing a spontaneous displacement/shaking etc., the bolt member 300 will not be displaced from its position and will therefore not affect the combination mechanism 200, neatly avoiding an undesired shift in the position of the components thereof.

In particular, the bolt member 300 cannot be displaced directly downwards due to the biasing spring 362. In other words, pressing down on the bolt member 300 or applying a similarly directed force thereto would entail also lateral displacement in the direction of arrow L1, due to the force applied thereto by the biasing spring.

It is appreciated that the chances for the bolt member 300 of spontaneously experiencing a set of forces applied thereto, first downwards and then rightwards as a result of a fall or sudden displacement are very slim, thereby preventing any shift in the combination mechanism 220.

It is important to note that in the present combination lock, there exists only one operative shank port, i.e., when the shank 10 is removed from the housing of the lock, there remains no portion of the shank (or shackle) in engagement with the bolt which would prevent its displacement as commonly known, for example, in a padlock (in which the other end of the shackle remains in engagement with the bolt).

The subject matter of the present application provides an elegant solution in which displacement of the bolt member 300 is arrested via engagement thereof solely with the housing of the lock 1. This can be particularly useful for cable locks as presented above but should be understood not to be limited thereto. In other words, the same arrangement can be provided for any other type of lock in which, in the open position, the bolt is not in association with the shank and/or in locks in which such association is not desired.

Figure 6A:
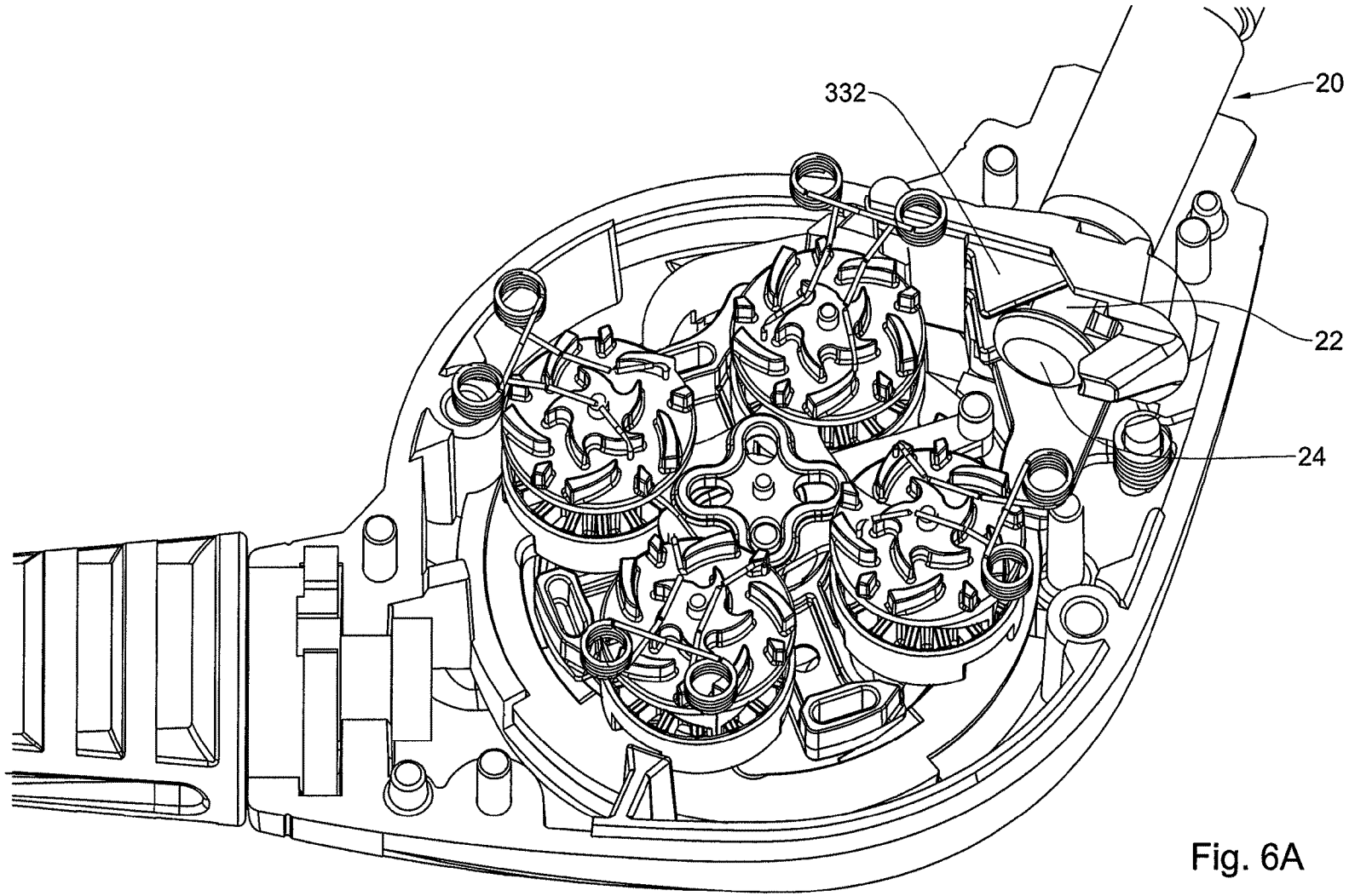
FIG. 6A is a schematic isometric view of the lock shown in FIGS. 1 to 3D in which a shackle of the bolt is shown during tampering.
Figure 6B:
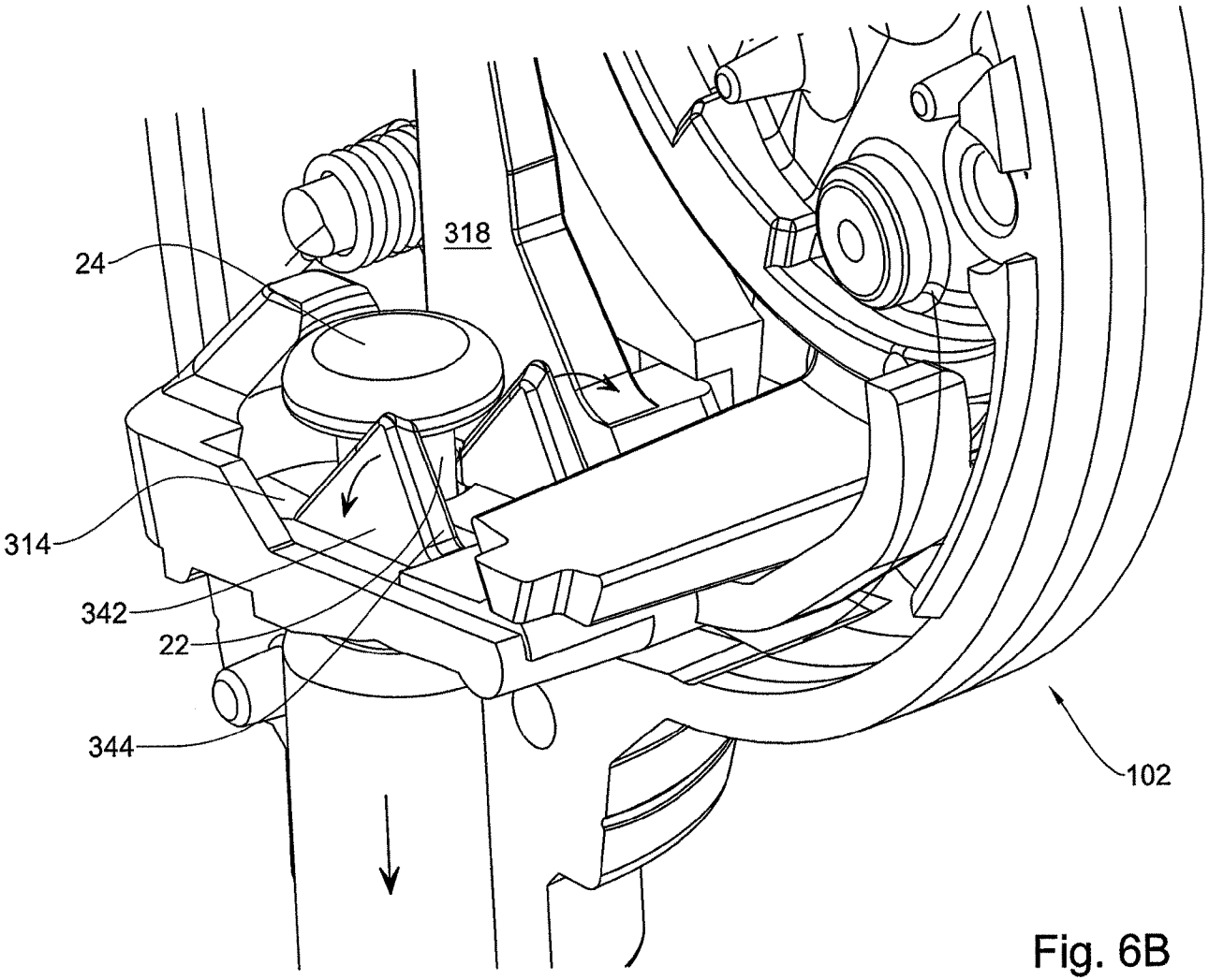
FIG. 6B is a schematic enlarged bottom isometric view of a portion of the lock shown in FIG. 6A.

Turning now to FIGS. 6A and 6B, a locked position of the lock 1 is shown in which the combination mechanism 200 is not set to the proper combination and therefore prevents displacement of the bolt member 300 in the lateral direction to allow proper extraction of the shank 10 from the lock 1.

In this position, tampering with the lock and/or pulling roughly on the shank 10 in an attempt to pull it out (for example, by a person tying to pry the lock) applies a force to the ribs 332, and consequently attempts urging the bolt member 300 to displace in the lateral direction. However, since the combination is not properly set in the combination mechanism 200, and the locking cross 220 is prevented from properly rotating, the lateral extension 315 and projection 317 of the bolt member 300 which abut the locking cross 220 are also prevented from displacing.

Applying an extensive load to the locking cross 220 as described above may lead to malfunction of the combination mechanism and release of the shank 20 (i.e. prying the lock). In order to prevent the load applied to the ribs 332 of the bolt member 300 from being transferred to the locking cross 220 and the combination mechanism 220, the design of the ribs 332 is such that the minimal load required for the ribs to collapse is lower than the load required to rotate the locking cross 220 against the combination mechanism 200 when the combination is not set.

Thus, when the pulling force on the shank 10 increases and reaches a predetermined level, the ribs 332 simply collapse. When collapsed, the head 24 of the shank 10 abuts the plate 311 around the small diameter opening directly and, as such, is incapable of applying any lateral force inducing lateral displacement of the bolt member 300.

In the above position, the collapsed ribs 332 render the bolt member 300 disabled, leaving the lock 1 in its locked position, also for the original user of the lock (in possession of the combination). However, this is still considered a better alternative for that of the lock being pried. The ribs 332 thus function also as an anti-tampering arrangement, preventing prying the lock by force. The ribs 332 thus also provide an indication for a failed attempt of prying the lock.

Those skilled in the art to which this invention pertains will readily appreciate that numerous changes, variations, and modification can be made without departing from the scope of the invention, mutatis mutandis.

The invention claimed is:

1. A combination lock, comprising:

a housing having a lock port configured for removably receiving therein a shank;

a locking bar received within the housing and having a shank port, said locking bar being configured for displacing at least between:

an open position in which the shank port is aligned with the lock port to allow a locking portion of said shank to displace into said housing through both ports, and a securing position in which said shank port is misaligned with the lock port to prevent the locking portion of the shank from displacing outside said housing via the shank port;

a combination mechanism associated with said locking bar and configured for switching between at least:

an unlocked position in which said locking bar is free to displace from its securing position to its open position, and a locked position in which said locking bar is arrested; and a securing arrangement constituted by an arresting member of the locking bar, an arresting portion of the housing, and a biasing mechanism, wherein:

said arresting member of the locking bar is configured for interlocking engagement with the arresting portion of the housing, said biasing mechanism is configured for urging said locking bar into the interlocking engagement with the arresting portion of the housing, and said securing arrangement being configured, when the locking portion of the shank is dislodged from the lock port, to prevent displacement of said locking bar from its open position.

2. The combination lock according to claim 1, wherein the biasing mechanism is configured for urging the locking bar to perform an angular displacement.

3. The combination lock according to claim 2, wherein the locking bar is provided with a sliding pivot portion configured for displacing together with the locking bar and for serving as a pivot point for the locking bar to perform rotation about a pivot axis, and wherein the locking bar is configured for performing both a lateral displacement and a pivotal displacement about the pivot point in order to switch between its open and securing position.

4. The combination lock according to claim 3, wherein lateral displacement of the locking bar is induced by axial displacement of the locking portion of the shank while pivotal displacement of the locking bar is induced by the biasing mechanism.

5. A locking bar for a combination lock, said locking bar comprising:

a shank port for axially receiving therein a locking portion of a shank;

at least one locking surface configured for operative engagement with the locking portion of the shank during its axial displacement into said shank port, for entailing displacement of said locking bar in a first lateral direction towards a securing position thereof;

at least one unlocking surface configured for operative engagement with the locking portion of the shank during its opposite axial displacement outside the shank port, for entailing displacement of said locking bar in an opposite lateral direction towards an open position thereof; and a tamper proof arrangement by which the at least one unlocking surface is configured for collapsing under the application of a predetermined load thereto, disabling the operative engagement with the locking portion of the shank.

6. The locking bar according to claim 5, wherein the at least one locking surface and the at least one unlocking surface of the locking bar are formed at different orientations from one another.

7. The locking bar according to claim 6, wherein locking and unlocking surfaces are oppositely oriented such that during displacement of the shank in one direction it only engages one of the surfaces whereas during displacement thereof in the opposite direction it only engages the other of the surfaces.

8. The locking bar according to claim 7, wherein, when the at least one unlocking surface is collapsed, the shank is out of engagement therewith, rendering it impossible to apply the desired force upon the locking bar in order to displace the locking bar to the open position.

9. The locking bar according to claim 8, wherein the at least one unlocking surface is formed along a rib projecting transversely from the locking bar.

10. The locking bar according to claim 6, wherein the locking bar is provided with a sliding pivot portion configured for displacing together with the locking bar and for serving as a pivot point for the locking bar to perform rotation about a pivot axis.

11. The locking bar according to claim 10, wherein the locking bar is configured for performing both a lateral displacement induced by axial displacement of the locking portion of the shank and a pivotal displacement about the pivot point induced by a biasing arrangement in order to switch between its open position and securing position.

* * * * *